United States Patent [19]

Akiyama et al.

[11] Patent Number: 5,052,832

[45] Date of Patent: Oct. 1, 1991

[54] PRINT HEAD AND ROLLER BIASING MECHANISM FOR A HAND HELD THERMAL PRINTER

[75] Inventors: Takaaki Akiyama; Shuji Matsuo; Masahiro Fujii; Mitsukazu Kurose; Osamu Nakamura; Masahiro Kamijo, all of Suwa, Japan

[73] Assignee: Seiko Epson Corporation, Tokyo, Japan

[21] Appl. No.: 378,667

[22] Filed: Jul. 12, 1989

Related U.S. Application Data

[62] Division of Ser. No. 198,536, May 25, 1988.

[30] Foreign Application Priority Data

| | | | |
|---|---|---|---|
| May 25, 1987 | [JP] | Japan | 62-127412 |
| May 25, 1987 | [JP] | Japan | 62-127413 |
| Jan. 13, 1988 | [JP] | Japan | 63-5081 |
| Jan. 13, 1988 | [JP] | Japan | 63-5082 |

[51] Int. Cl.[5] ..... B41J 2/325

[52] U.S. Cl. ..... 400/120; 400/88; 400/193

[58] Field of Search ..... 400/29, 88, 120, 120 HH, 400/193, 236, 236.2, 248, 249

[56] References Cited

U.S. PATENT DOCUMENTS

| | | | |
|---|---|---|---|
| 3,767,020 | 10/1973 | Rowe | 400/29 X |
| 4,750,049 | 6/1988 | Murakami et al. | 400/29 X |
| 4,819,083 | 4/1989 | Kawai et al. | 400/29 X |

FOREIGN PATENT DOCUMENTS

| | | | |
|---|---|---|---|
| 0285024 | 10/1988 | European Pat. Off. | 400/88 |
| 0020387 | 2/1982 | Japan | 400/248 |
| 0240470 | 11/1985 | Japan | 400/29 |
| 0240471 | 11/1985 | Japan | 400/29 |
| 166851 | 10/1986 | Japan | 400/88 |
| 0283574 | 12/1986 | Japan | 400/29 |
| 28275 | 2/1987 | Japan | 400/88 |
| 0090267 | 4/1987 | Japan | 400/88 |
| 0161567 | 7/1987 | Japan | 400/88 |
| 0222864 | 9/1987 | Japan | 400/120 HH |
| 0225372 | 10/1987 | Japan | 400/88 |
| 0244670 | 10/1987 | Japan | 400/193 |
| 0244683 | 10/1987 | Japan | 400/88 |

*Primary Examiner*—David A. Wiecking
*Attorney, Agent, or Firm*—Blum Kaplan

[57] ABSTRACT

A hand held printer for printing on a print paper when the printer is manually moved over the surface of the paper is provided, including a print mechanism supported within the housing to print inputted characters and drawings on the print paper upon manual manipulation of the housing. A thermal head is movably supported within the housing. A movement measurement unit indicates movement of the printer. A drive roller drives a ribbon take up roller and movement measurement unit. A clutch allows the drive roller to function only in a printing direction. A spring biases the drive roller towards an operating position, the drive roller moving to the print surface independently of the thermal head when the drive roller is biased by the spring.

13 Claims, 21 Drawing Sheets

FIG. 5
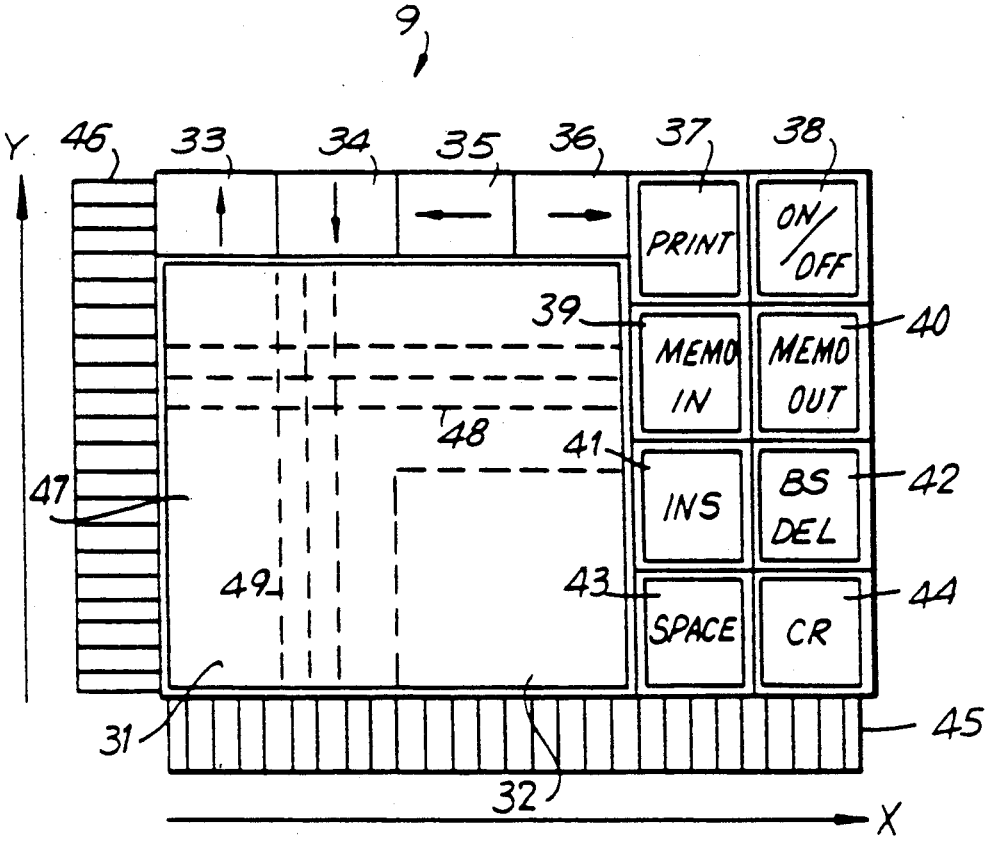
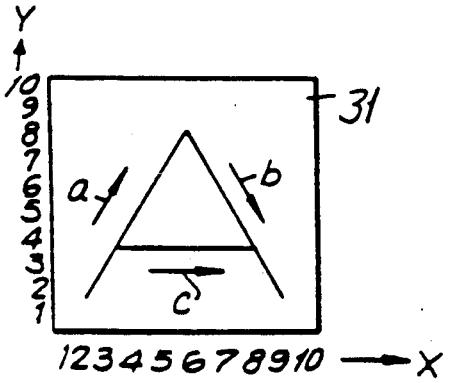
FIG. 6
(X, Y)
a: (2,2) (3,4) (4,6) --- (5,9)
b: (5,9) (6,8) (7,6) --- (9,2)
c: (3,4) (4,4) (5,4) --- (8,4)

FIG. 11
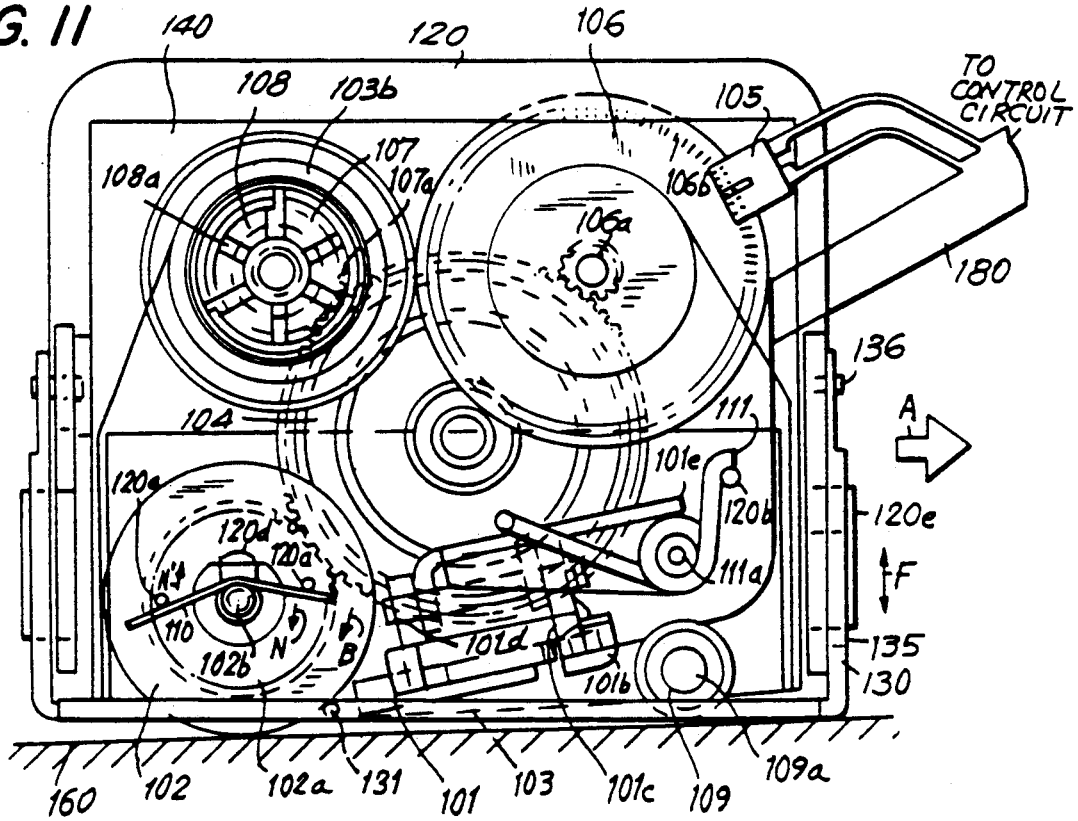
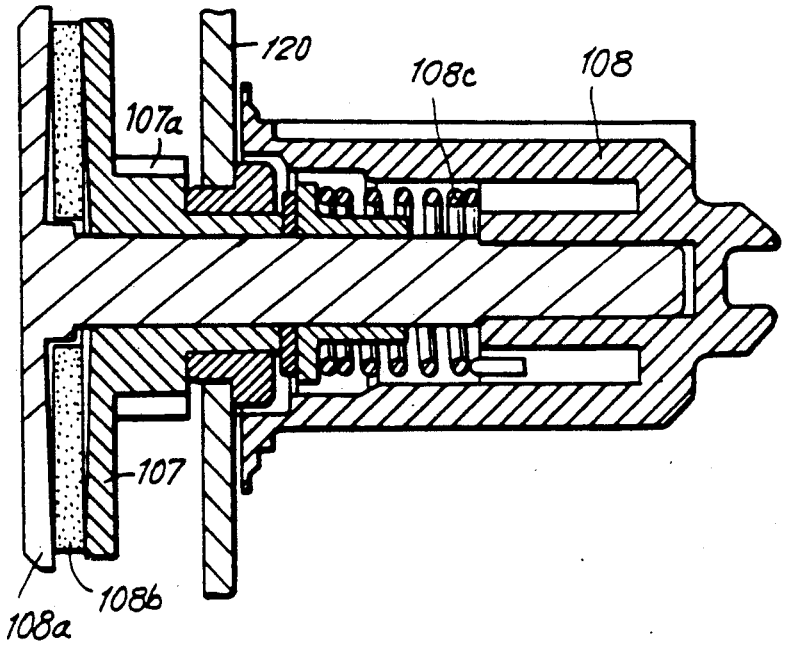
FIG. 12

FIG. 18
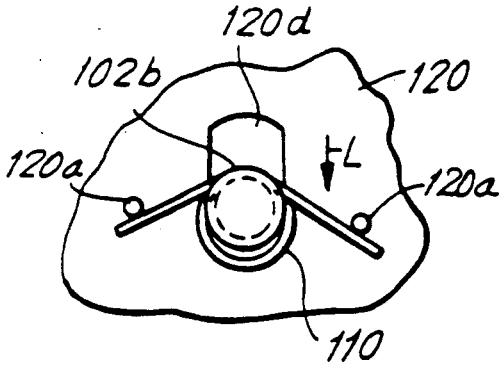
FIG. 19
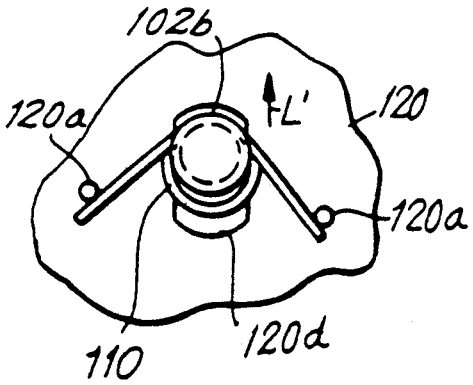
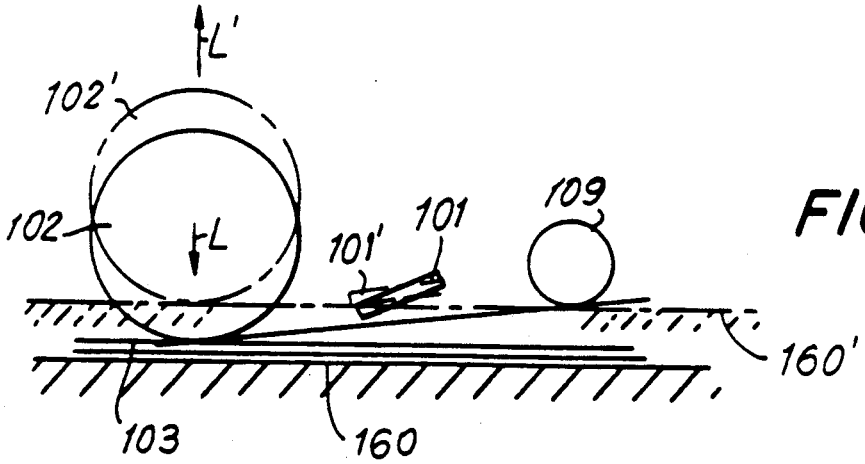
FIG. 20
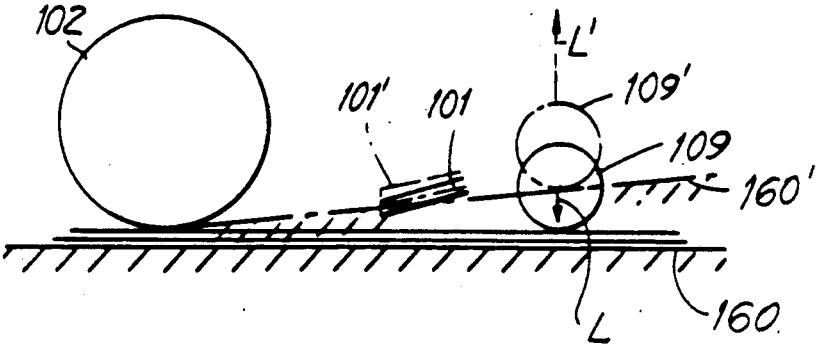
FIG. 21

FIG. 24
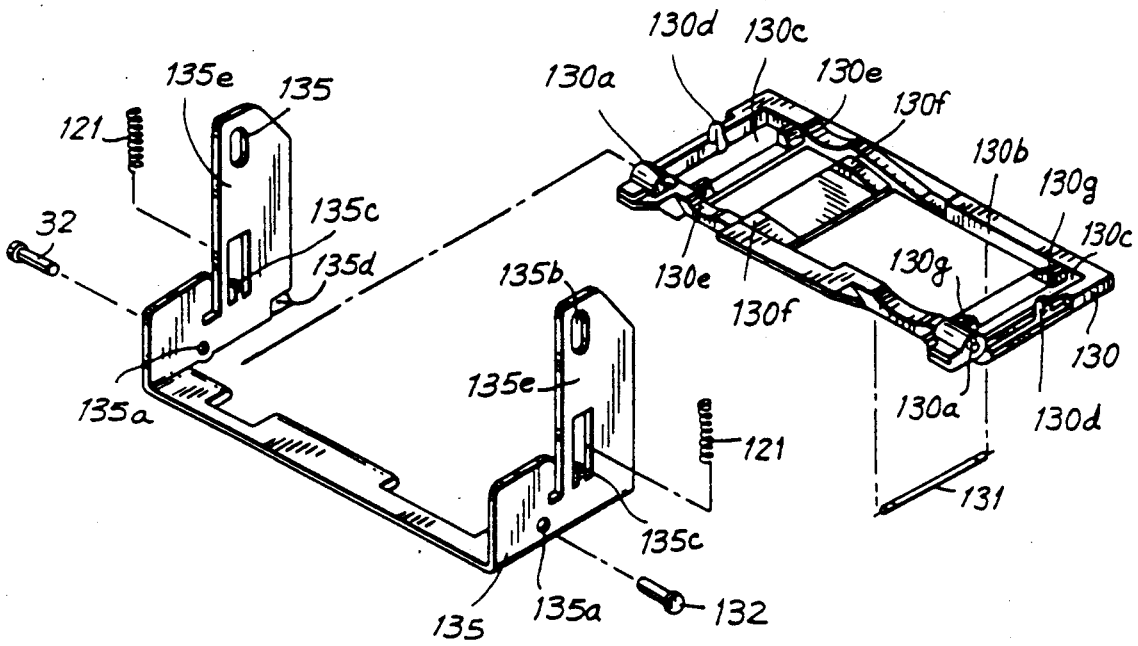
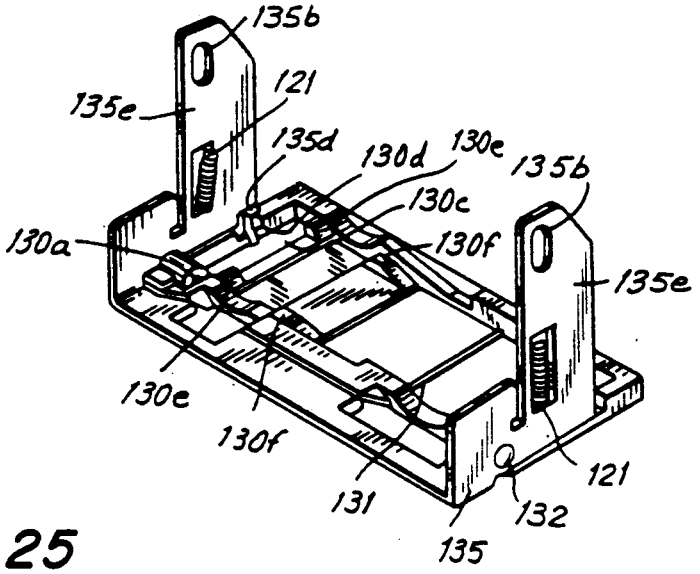
FIG. 25

FIG. 29
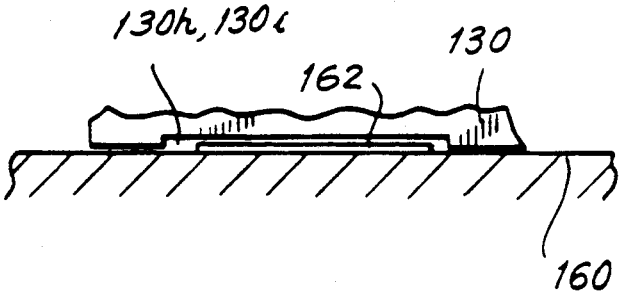
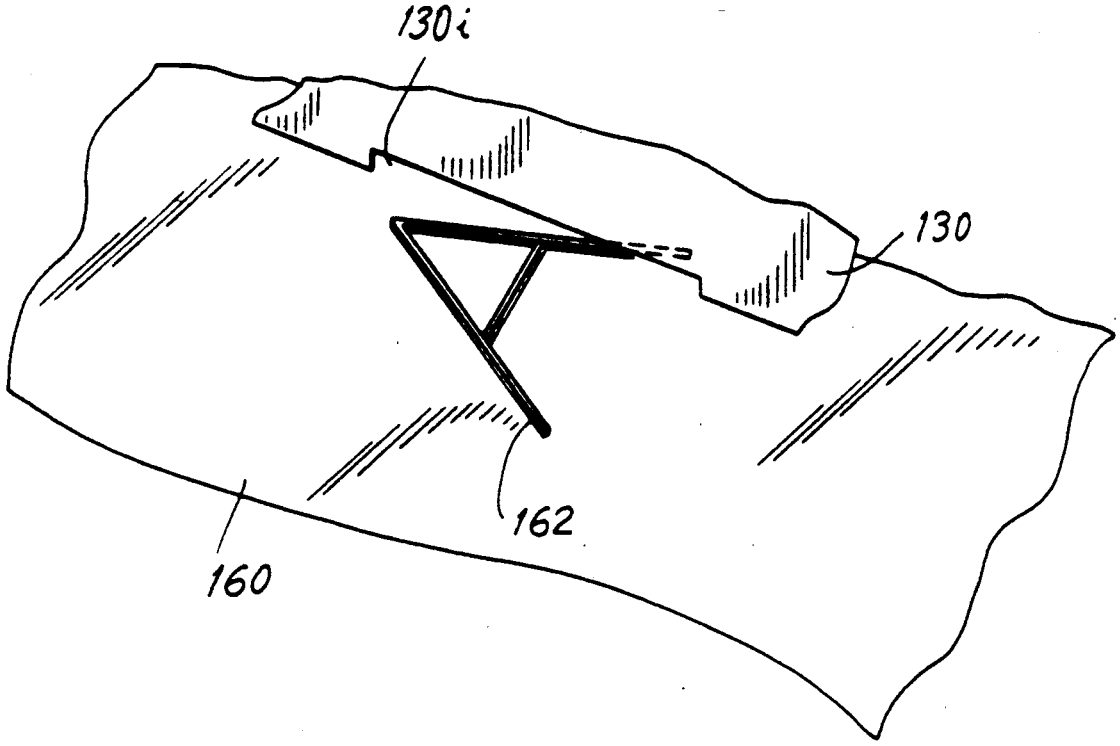
FIG. 30

PRINT HEAD AND ROLLER BIASING MECHANISM FOR A HAND HELD THERMAL PRINTER

This is a division of application Ser. No. 198,536, filed on May 25, 1988.

BACKGROUND OF THE INVENTION

The present invention relates generally to a hand held printer which prints both characters and drawings on a print paper in response to manual movement of the printer over the surface of the print paper, and more particularly, to a hand held printer which incorporates an input unit, a display unit, a character storage unit and a printing device in a single housing.

In order to understand the background of the invention, reference is first made to FIG. 1 wherein a conventional hand held printer, generally indicated at 100, for printing on a print paper through manual movement over the paper, is depicted. Because of the manual operation of such hand held printers, the plurality of motors usually required to drive a normal carriage contained printer and the control circuits for controlling those motors are not needed thereby allowing for greater miniaturization and portability. However, to control the printing, the conventional hand held printer has to be connected to a large host unit 75 through interface cables 74A and 74B. Printer 100 has a manually movable body 70 movable over a print surface 160 which contains a position detector 72 which is rotated by a roller 69 when body 70 is manually moved over print surface 160. An encoder 73 detects the motion of position detector 72 and produces signals which are detected by host unit 75. Host unit 75 detects the pulse signals from encoder 73 and a control unit within host unit 75 outputs a pattern of characters and drawings to a print head 71 in response to the pulse signals from encoder 73 in order to print on surface 160 as printer body 70 is moved thereover. In such an apparatus, the pattern of the characters and drawings to be printed by print head 71 are input using a separate input unit 76, a separate display unit 77 and a separate storage unit in host unit 75. Such a conventional printer is disclosed in U.S. Pat. No. 3,767,020, issued Oct. 23, 1973 to Rowe.

Conventional hand held printers are known in the art as illustrated by Japanese Laid Open Patent Nos. 60-109866, 62-244683 and 61-283574 and Japanese Laid Open Utility No. 61-16685. In these conventional hand held printers, a thermal ink ribbon is sandwiched between a fixed roller and the print surface. The ink ribbon is moved by the manual movement of the hand held printer over the print paper. Printing may also be accomplished by pressing the printer on the paper and manually moving the printer to perform the printing.

Additionally, many hand held lettering tape printing devices have also been proposed. These require a motor for driving the roller which draws out the ink ribbon and the lettering tape as well as motors for controlling the ink ribbon take up reel. Additionally, a control circuit for controlling the motor is required resulting in a large sized apparatus. Accordingly, printing is possible only on special lettering tapes.

These hand held printers have been less than satisfactory. It is impossible to use the conventional hand held printer without the associated input unit, display unit, storage unit and control unit of a host unit. Accordingly, even if the hand held printer is small and portable the apparatus itself is not portable due to the large sized associated control units. Additionally, the structure of the prior art hand held rollers results in unstable application of pressure by the thermal head and the roller on the ink ribbon during manual operation. Accordingly, only the pressure of the thermal head acts on the ribbon and the pressure applied on the ribbon by the printing surface of the roller is either very small or non-existent. When this occurs, the roller cannot rotate and it becomes impossible to feed and take up the thermal ink ribbon. The thermal ink ribbon runs out from the printer causing undesirable staining of the print surface making a usable print operation impossible. Furthermore, the print roller slips due to the interlocking of the thermal ink ribbon during operation. When the roller does slip, it falls out of sync with the signal sent by the encoder corresponding to the displacement of the hand held portion of the printer across the surface. Because the host unit no longer has accurate data as to the distance moved by the hand held printer, the characters or drawings are printed out of sync with the actual displacement of the printer resulting in misformed printed symbols.

The roller also acts as the ink ribbon take up roller for the used up thermal ink ribbon. The roller relies on the driving forces generated by the friction of the roller engaged with the print surface when the roller presses the ink ribbon onto the printing paper during operation. This requires that a large downward force be applied to the printer to obtain an adequate friction and driving force to take up the thermal ink ribbon. When such a force cannot be provided, the ribbon is not taken up by the roller, resulting in the thermal ink ribbon running out from the printer causing major defects in the printed symbol such as staining of the printed surface making operation of the printer impossible. On the other hand, when large forces are applied to the hand roller they tend to damage the hand held printer due to deterioration of parts due to the operation under high pressures, forces and stresses.

Additionally, the conventional hand held printers do not contain a ribbon guide member for guiding the travel direction of the thermal ink ribbon through the printer during printing. This results in displacement, loosening, jamming and the projecting of the ink ribbon from the thermal head during operation causing deterioration of print quality and deterioration in the maintainence of print consistency during operation. Such conventional hand held printers which do include a ribbon guide still result in handling problems of the travelling surface resulting in poor operation, detachment of the ribbon when the ribbon cassette is detached from the hand held printer and related problems. Additionally, due to the gap between the thermal head and the print surface or inconsistencies in the print surface, the thermal ink ribbon and thermal print head do not closely adhere to the printing surface causing misprinting of the symbols to create light and dark areas.

Accordingly, it is desired to provide an improved hand held printer which overcomes the shortcomings of the prior art and which achieves the objects and benefits associated with a completely portable, manually activated printer.

SUMMARY OF THE INVENTION

Generally speaking, in accordance with the present invention, a hand held printer which prints on a print paper by manual movement of the printer on the surface of the paper, is provided. A housing supports a thermal head. A thermal transfer ink ribbon is supported within the housing and is collected on a take up roller. A driving roller is engaged with the take up reel. The ink ribbon passes over the driving roller prior to being wound up on the take up reel. A printer movement detector detects the relative movement of the hand held printer over the print paper and provides a control signal to a control unit in the housing which controls the relative operation of the thermal head. A character input device and display device are both contained within the housing. The drive roller is displaced to come in contact with the printing surface.

The housing may also include roller guides formed as groove shaped members for supporting the drive roller so that it is slidable relative to the printed surface. A support member supports the drive roller within the housing and is rotatable relative to the printed surface. The drive roller may also be constructed with a concave portion for receiving the thermal ink transfer ribbon and allowing the thermal ink transfer ribbon to pass about the concave portion of the drive roller.

The printer may also include a thermal ribbon guide for positioning a thermal ribbon relative to the thermal print head. The ribbon is stored in a ribbon cassette which includes the thermal ribbon. When attaching or detaching the cassette from the housing, the ribbon guide engages a slide guide which is slidable relative to the printed surface and is opened and closed in a direction away from the thermal ribbon and the ribbon cassette. The ribbon is also guided by a roller which is rotatably mounted to trail the thermal head during operation of the hand held printer.

The hand held thermal head printer may also include a tape storage reel and a roller platen for pressing the tape surface against an ink ribbon and thermal print head. A detector for detecting the amount of tape travelling past the thermal head is also provided.

Accordingly, it is an object of this invention to provide an improved hand held printer which prints on a paper when the printer is manually moved on the surface of the paper.

Another object of this invention is to provide a hand held printer which is small enough to be conveniently used.

A further object of the present invention is to provide a hand held printer which incorporates the input and display of the information to be printed into a single hand held unit.

Yet another object of the invention is to insure good print quality in a hand held printer by avoiding major defects through the smooth feeding and taking up of the thermal ink ribbon.

Still another object of the present invention is to provide a cover which opens and closes about the ink ribbon through sliding upon the application of pressure to provide a simple guide for the thermal ink ribbon.

Yet another object of the present invention is to provide a hand held printer having a detachable ink ribbon cassette and which provides excellent print quality.

Still a further object of the present invention is to provide a small portable tape printer using a general purpose tape in a simple mechanism.

Still other objects and advantages of the invention will in part be obvious and will in part be apparent from the specification and drawings.

The invention accordingly comprises features of construction, combination of elements and arrangements of parts which will be exemplified in the constructions hereinafter set forth and the scope of the invention will be indicated in the claims.

BRIEF DESCRIPTION OF THE DRAWINGS

For a fuller understanding of the invention, reference is accompanying drawings, in which:

FIG. 5 is a front elevational view of a character input tablet in accordance with the invention;

FIG. 6 is a schematic diagram indicating the input of a character on the input tablet of FIG. 5 showing the associated X—Y coordinates of the letter A;

FIG. 11 is a sectional view of the printer mechanism in accordance with the invention;

FIG. 12 is a sectional view of the winding reel for the ink thermal ribbon in accordance with the invention;

FIG. 18 is a partial view of the driving roller prior to manual operation of the print roller in accordance with the invention;

FIG. 19 is a partial view of the drive roller during manual operation of the hand held printer in accordance with the invention;

FIG. 20 is a schematic illustration of one embodiment of the printing mechanism of the hand held printer in accordance with the invention;

FIG. 21 is a schematic illustration of a second embodiment of the printing mechanism of the hand held printer in accordance with the invention;

FIG. 24 is an exploded view of the ribbon cover and slide plate assembly of the printing mechanism in accordance with the invention;

FIG. 25 is a perspective view of the ribbon cover and slide plate assembly of the printing mechanism in accordance with the invention;

FIG. 29 is an elevational view showing the clearance according to an embodiment of the invention;

FIG. 30 is a perspective view of the ribbon cover of FIG. shown after formation of the letter A according to an embodiment of the invention;

DETAILED DESCRIPTION OF THE PREFERRED EMBODIMENTS

Figure 1:
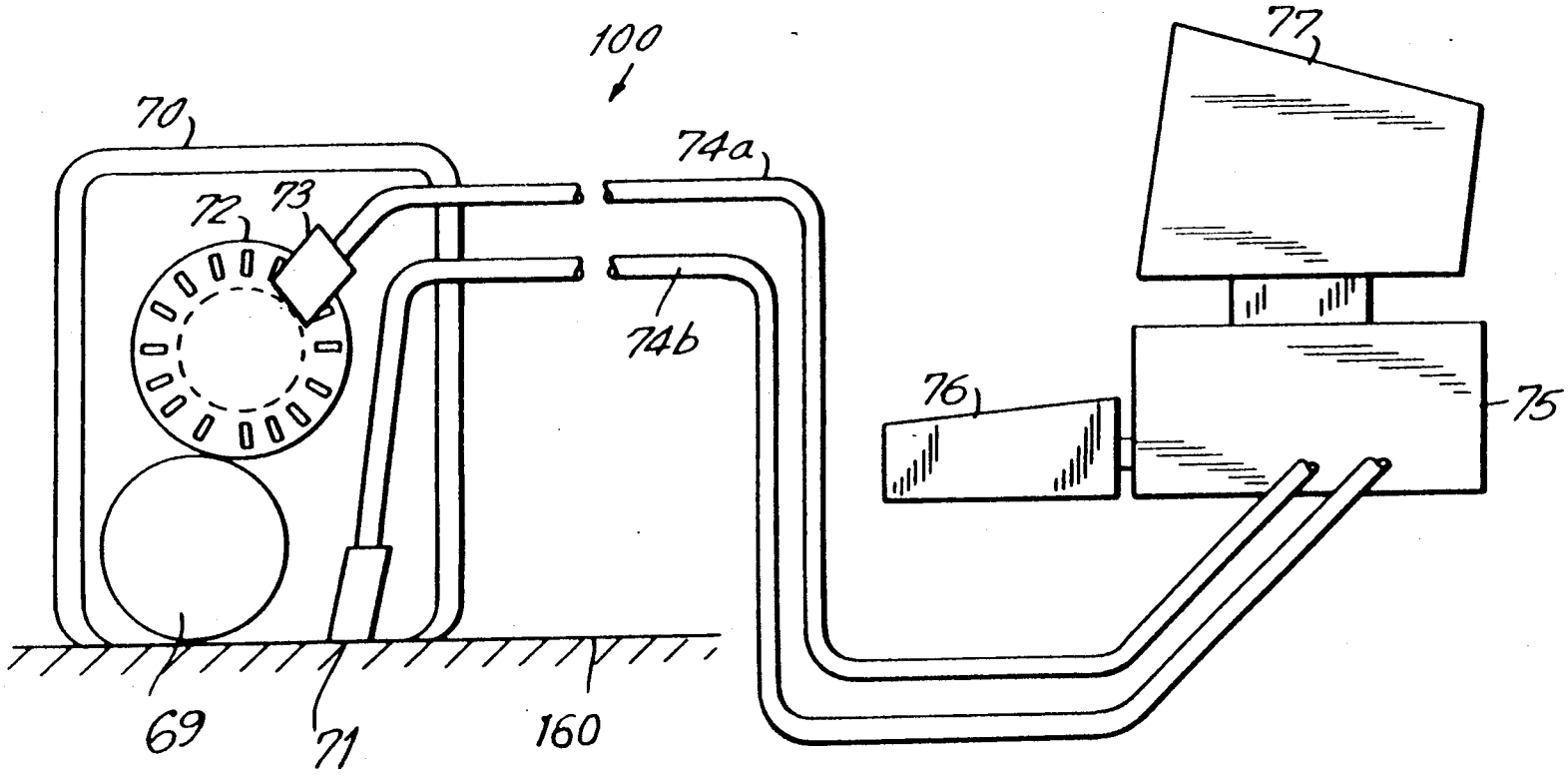
FIG. 1 PRIOR ART
FIG. 1 is a schematic view of a hand held printer coupled to a large host unit constructed in accordance with the prior art.
Figure 2:
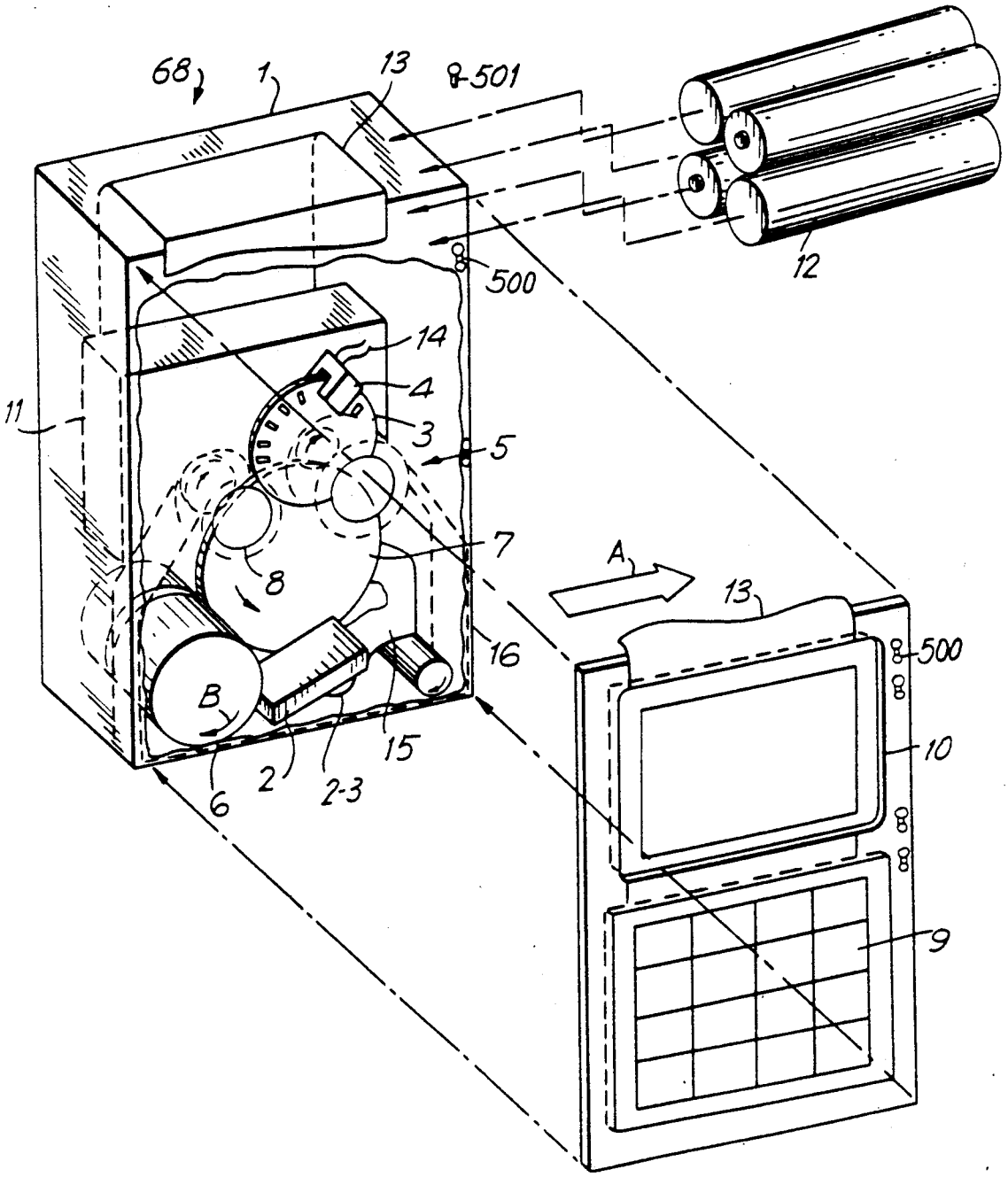
FIG. 2 is a partially exploded perspective view of a first embodiment of a hand held printer in accordance with the present invention.
Figure 3:
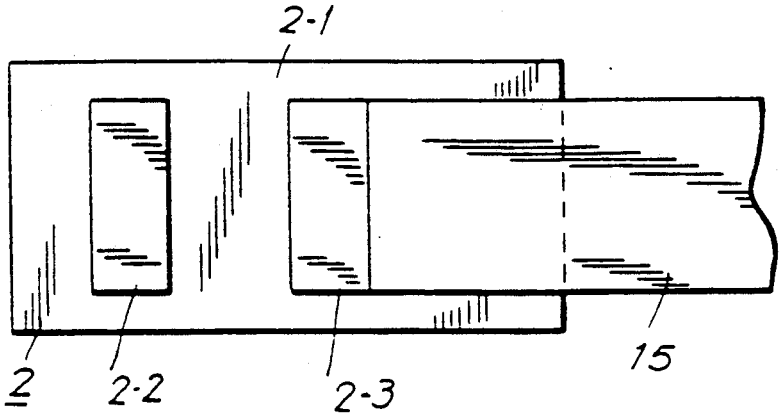
FIG. 3 is a bottom plan view of the thermal head used in the printer in accordance with the invention.

Reference is first made to FIGS. 2 and 3 wherein a hand held printer, generally indicated as 68, is depicted. Printer 68 includes a body or housing 1 which supports therein a printing mechanism 5 including a thermal head 2 forming the printing apparatus of the hand held printer 68. A rotatable detecting plate 3 for detecting the amount of movement of printing mechanism 5 relative, to a print surface 160 is provided. A photo detector 4 of printing mechanism 5 cooperates with detecting plate 3 for indicating the amount of movement of printer 68. A tablet 9 for inputting the characters to be printed and a dot matrix liquid crystal display 10 for displaying the characters to be printed are supported on the front side of housing 1. A control unit 11, which includes a storage unit such as memory unit 55 and a character generator is 27 (FIG. 4) is supported within housing 1 behind printing mechanism 5 and controls the operation of printer 68. Batteries 12 act as a power source for the printer 68 and are retained in the top half of housing 1. Tablet 9 and liquid crystal display 10 are coupled to control unit 11 through a flat cable 13. Photo detector 4 is coupled to control unit 11 through a cable 14, and thermal head 2 is coupled to control unit 11 through cable 15.

A thermal transfer tape or ribbon 16 travels through housing 1 and is wound about take up reel 8. A drive roller 6 engages print surface 160 to rotate in the direction of arrow B when printer 68 is operated and manually moved along the print surface 160 in the direction of arrow A. Drive roller 6 engages a transmitting gear 7 which in turn engages take up reel 8 and detecting plate 3 causing each to rotate upon movement of drive roller 6. Printing mechanism 5 is constructed to perform printing by sliding body 1 in the direction of arrow A on print surface 160.

As shown in FIG. 3, thermal head 2 includes a plurality of heating elements 2-2 which are aligned at one end of the surface of a substrate 2-1 of thermal head 2. A driver 2-3 for supplying current to heating elements 2-2 is aligned with heating elements 2-2. Thermal head 2 is supported in housing 1 at an incline toward thermal transfer ribbon 16, enabling further miniaturization of printer 68, while attaining an effective use of available space within housing 1.

The side on which tablet 9 and display 10 are located on housing 1 may be formed with a hinge mechanism including hinge 500 and pin 501 or the like to allow opening and closing of housing 1 of printer 68.

Figure 4:
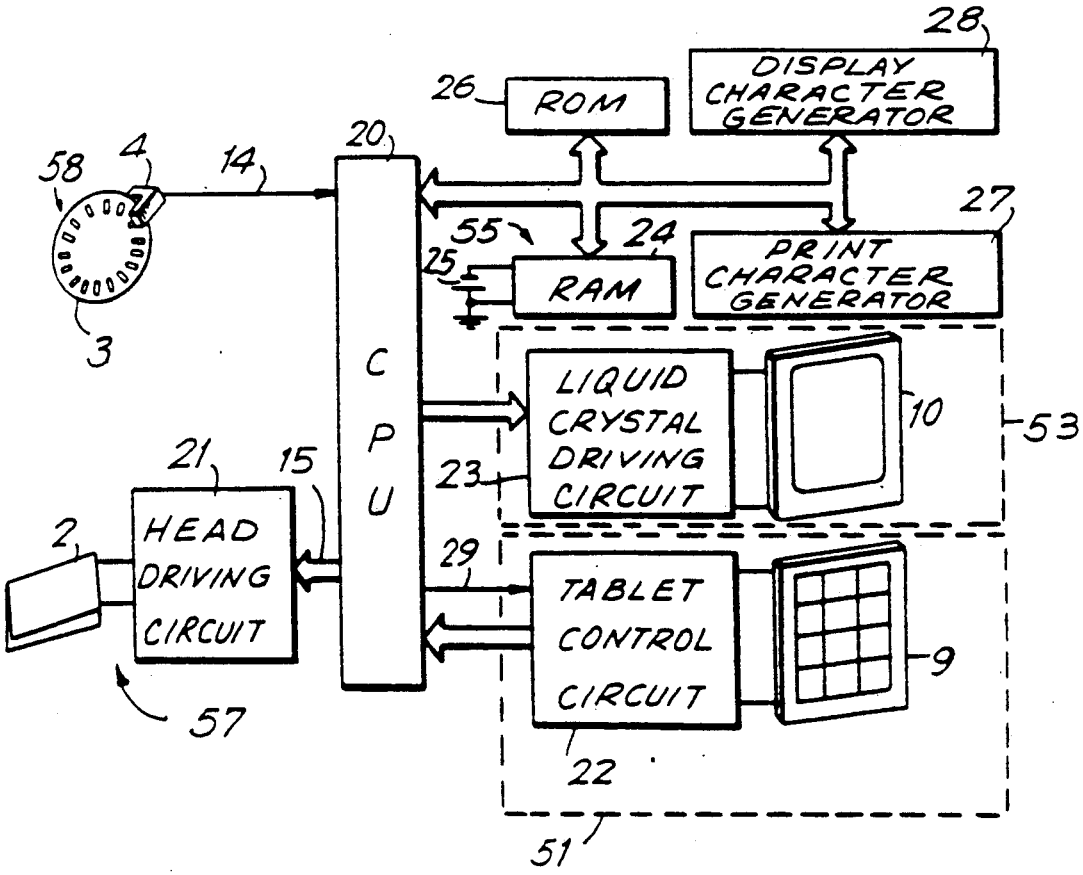
FIG. 4 is a block diagram depicting one embodiment of the control system of the hand held printer in accordance with the invention.

Reference is now made to the block diagram of FIG. 4 to describe the operation of printer 68. Printer 68 includes an input unit 51 for inputting the characters to be printed, a display unit 53 for displaying the printed characters, a memory or storage unit 55 for storing the input symbols and a printing unit 57. Input unit 51 includes tablet 9 and a tablet control circuit 22. Display unit 53 includes liquid crystal display 10 and a liquid crystal driving circuit 23. Memory unit 55 includes a RAM 24 and an associated backup power source 25. Printing unit 57 includes thermal head 2 and a head driving circuit 21. A detector 58 for detecting the amount of movement during manual operation of printer 68 includes detecting plate 3 and photo detector 4. Photo detector 4 outputs a detecting signal corresponding to the amount of movement of printer 68 which is input to a central processing unit of a direct control unit (CPU) 20. A print character generator 27 causes printing unit 57 to print characters. Similarly, a display character generator 28 causes display 10 to display characters. The control unit includes CPU 20 and a ROM 26 for controlling each of the units. As aforenoted, batteries 12 act as the main power source.

Figure 5A:
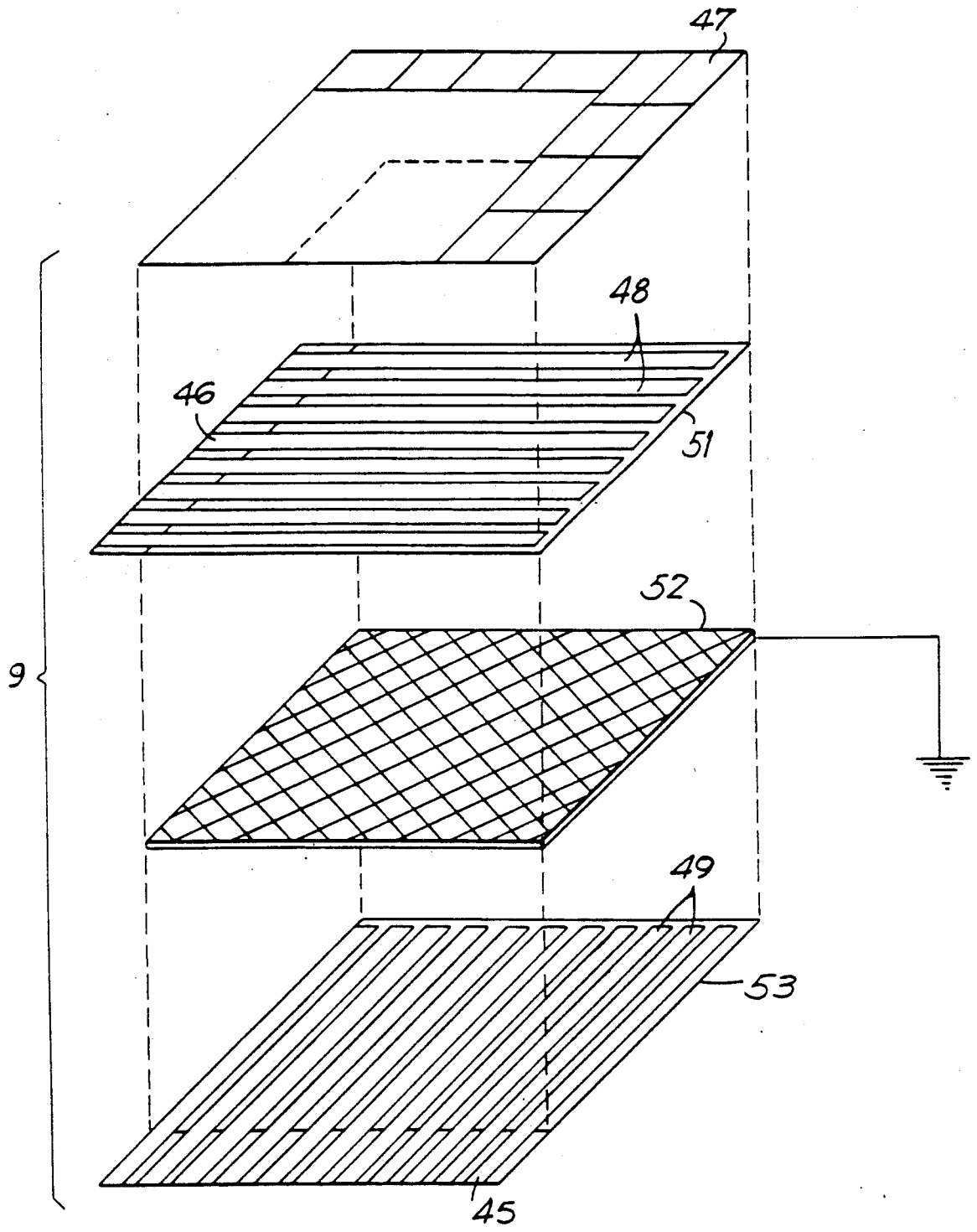
FIG. 5A is an exploded view of the character input tablet of FIG. 5.

Reference is now made to FIGS. 5 and 5A wherein input tablet 9 is depicted in detail. Tablet 9 is a small input unit and includes a gum sheet 47 located at the surface of tablet 9 and an insulating sheet 52 and substrate 53 disposed beneath the gum sheet 47 and separated therefrom by a slight gap. A plurality of electrodes 48 forming lines extending in the X direction separated at predetermined intervals are formed on the inner side of gum sheet 47. A plurality of electrodes 49 forming lines extending in the Y direction, perpendicular to the lines formed in the X direction, at predetermined intervals are formed on the insulating sheet. Each electrode 48 will cross each electrode 49 in spaced relation at a right angle. Accordingly, if the surface of gum sheet 47 is traced by a handwriting implement on its display side, electrodes 48 and 49 in the corresponding X and Y directions below the trace portion are sequentially contacted. Each contact produces a signal so that the cross point of each electrode 48 and 49 is detected and input to tablet control circuit 22 through its respective conductive lines 45 and 46. As seen in FIG. 5A, gum sheet 47 is provided to cover the surface tablet 9. Tablet 9 includes a gum sheet 47, vinyl sheet 51, an insulating sheet 52 and a substrate 53. Insulating sheet 52 acts as ground. Electrode 48 is printed on the rear surface of vinyl sheet 51 and electrode 49 is printed on a surface of substrate 53. When pressure is applied to gum sheet 47 by a pen or the like, which pressure is sensed so that electrodes 48 and 49 are grounded to the insulating sheet 52 and the potential becomes 0.

Each electrode 48, extending in the X direction is connected to one conductive line 45 and similarly, each electrode 49 extending in the Y direction is connected to one conductive line 46. By pressing one point on the tablet 9, the respective terminals of conductive lines 45 and 46 extending from the side of tablet 9 detect the press point as a respective X coordinate value and a respective Y coordinate value. Accordingly, a symbol may be considered as a group or set of coordinate points found on an X, Y plane. Tablet control circuit 22 detects these X, Y coordinate values and transmits this data to CPU 20 in response to a trigger signal 29 from CPU 20.

Tablet 9 has on its surface input portions 31 and 32 for inputting characters and inputting drawings. Cursor control keys 33, 34, 35 and 36 are provided for indentifying the characters. Editing keys 41, 42, 43 and 44 edit the characters input on input portions 31 and 32. A print key 37 initiates printing and a power switch 38 provides on-off operation of the device. Memory keys 39 and 40 are also provided. When a small letter is to be input, portion 32 of tablet 9 located at the lower right hand corner of portion 31 for inputting larger letters is provided.

Letters are input through tablet 9 by on-line handwriting of the letter in either input portion 31 or input portion 32. As shown in FIG. 6, a letter or character drawing input into portion 31 of tablet 9 may be represented by a series of X, Y coordinates which follow the handwritten trace lines. For example, the letter A is written with three traced lines a, b and c. Line a may be represented as a series of points along the grid formed by electrodes 49, 48 such as (2, 2) (3, 4) (4, 6) . . . (5,9). Similarly, the line b is represented as the coordinate points (5, 9) (6, 8) (7, 6) . . . (9,2). The third line c is represented as (3, 4) (4, 4) (5, 4) . . . (8,4). Accordingly, the handwritten information which is input is transformed into usable data for CPU 20.

After a first letter is written, execute key 44 is pushed. This causes the transfer signal 29 to be sent from CPU 20 to tablet control circuit 22 causing tablet control circuit 22 to transfer the above values of each X coordinate and corresponding Y coordinate to CPU 20. CPU 20 performs pattern matching of the obtained values for each X coordinate and Y coordinate with standard traced data stored within a ROM 26. The inputted trace data transmitted by tablet control circuit 22 is compared with known expected values stored within ROM 26 so that a letter code of the character having a high consistent ratio with a pattern of recognized value is output as the letter code.

The letter code output from CPU 20 is stored in storage unit 55 (RAM 24). CPU 20 calls a font corresponding to the letter code stored in RAM 24 from the display character generator 28 and then transmits a character of that selected font font to the liquid crystal driving circuit 23 which causes the display of the font on liquid crystal display 10.

Drawings are input by directly writing the drawing on character drawing input portion 31 of tablet 9. To distinguish the character to be drawn from other inputs, the termination of the inputting of the character is signaled to CPU 20 through the pressing of a space key 43 upon the completion of the inputting of the character. The drawings are also coded as above and stored by CPU 20 as coordinate points in RAM 24.

Letters and characters may be input as strings forming sentences. Amending and revising the inputted sentences is conducted through editing keys 41–44. Editing keys 41–44 include an insert key 41, a delete/cancel key 42, a space/non-select key 43 and a carriage return execute key 44. During editing, CPU 20 recalls sentences stored in storage unit 55 (RAM 24) to perform the identifying, deleting, inserting and amending of the character in accordance with instructions from editing keys 41–44. During this time, the editing operation is displayed on liquid crystal display 10 through liquid crystal driving circuit 23. As shown in greater detail in FIG. 7, a cursor 50 appears on liquid crystal display 10 and is operated through cursor keys 33-36. A character exhibited on liquid crystal display 10 may be deleted through the use of delete key 42. To amend a sentence or character, cursor 50 is moved to the position or character to be amended, the character at that position is deleted through the use of delete key 42 and a character may be inserted at that position by utilizing insert key 41. Through the use of cursor 50, delete key 42 and insert key 41, amendment or revision of characters and sentences is performed.

Figure 7:
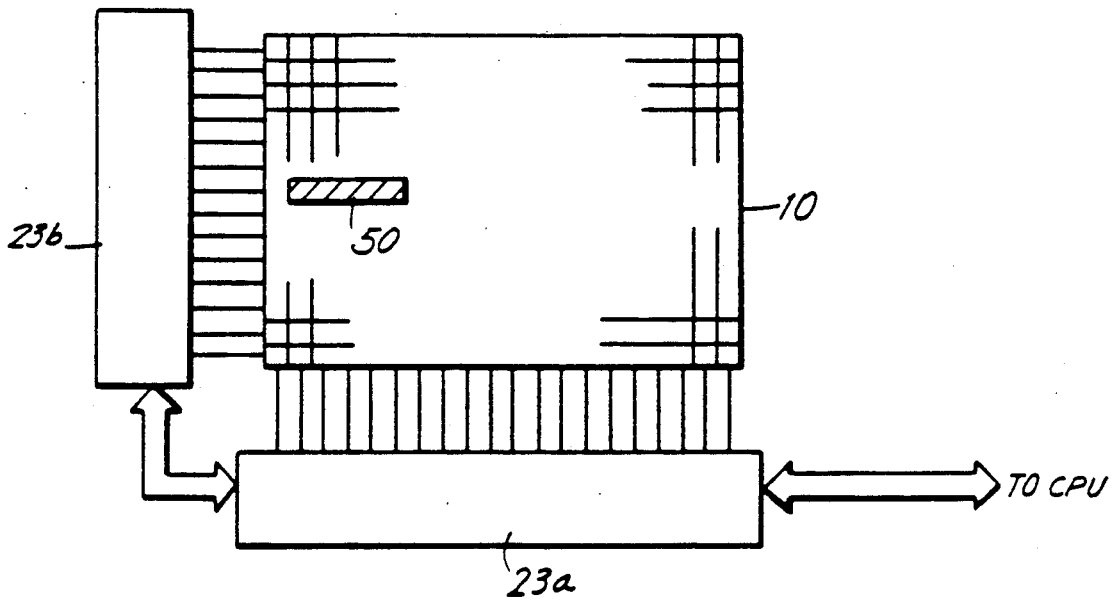
FIG. 7 is a schematic view of a liquid crystal display in accordance with the invention.

Liquid display crystal 10 is a dot matrix liquid crystal display. As shown in FIG. 7, liquid crystal driving circuit 23 includes a first driving circuit 23*a* to drive liquid crystal display 10 in the column direction and a driving circuit 23*b* to drive liquid crystal display 10 in the row direction. Liquid crystal display 10 is of the dot matrix type which controls the on or off signal of each dot, enabling the display of relatively simple patterns such as characters, Chinese characters, drawings and the like. Liquid crystal driving circuit 23 receives the dot pattern of the input characters and drawings from CPU 20 to cause the displaying of the input characters and drawings at the associated dot positions as instructed by CPU 20. Cursor 50 is displayed on liquid crystal display 10 and as described above acts as a pointer during inserting and deleting of characters. The characters generated by display character generator 28 are transmitted by CPU 20 to display unit 53 and are displayed at the position of cursor 50 on liquid crystal display 10.

Figure 8:
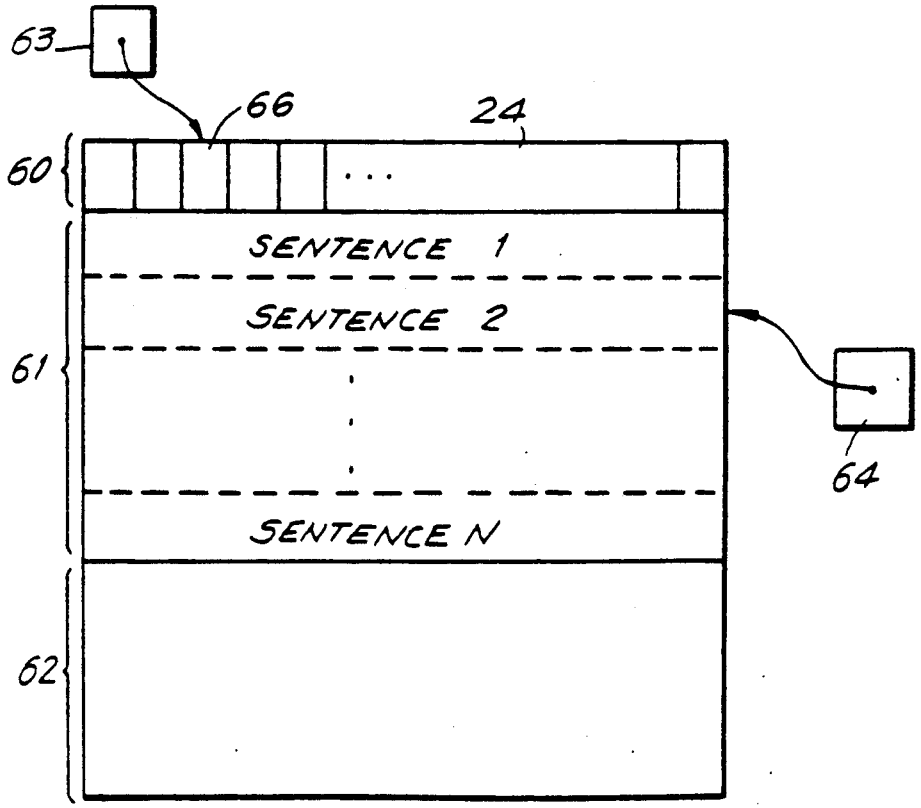
FIG. 8 is a schematic view of a character storage RAM in accordance with the invention.
Figure 9:
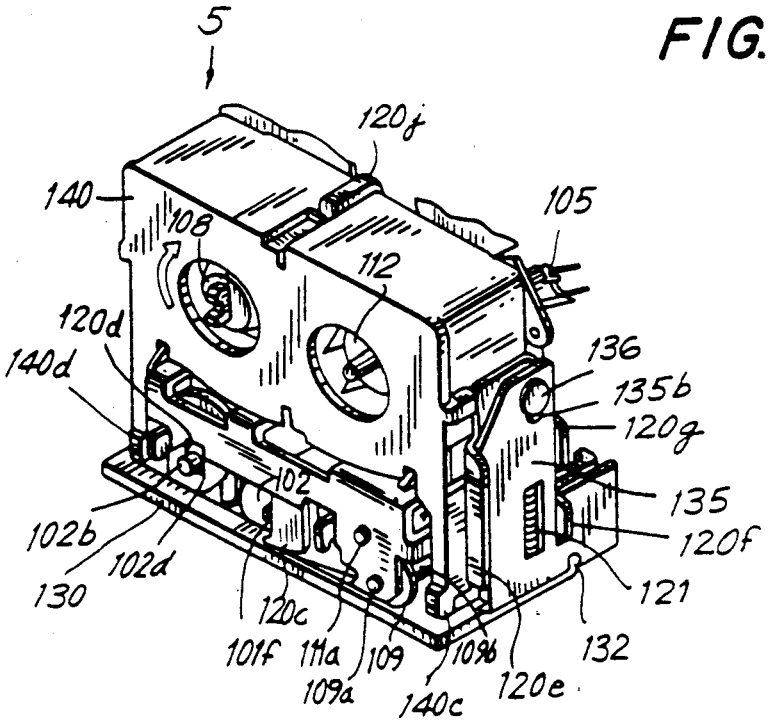
FIG. 9 is a perspective view of one embodiment of the printing mechanism of the hand held printer in accordance with the invention.
Figure 10:
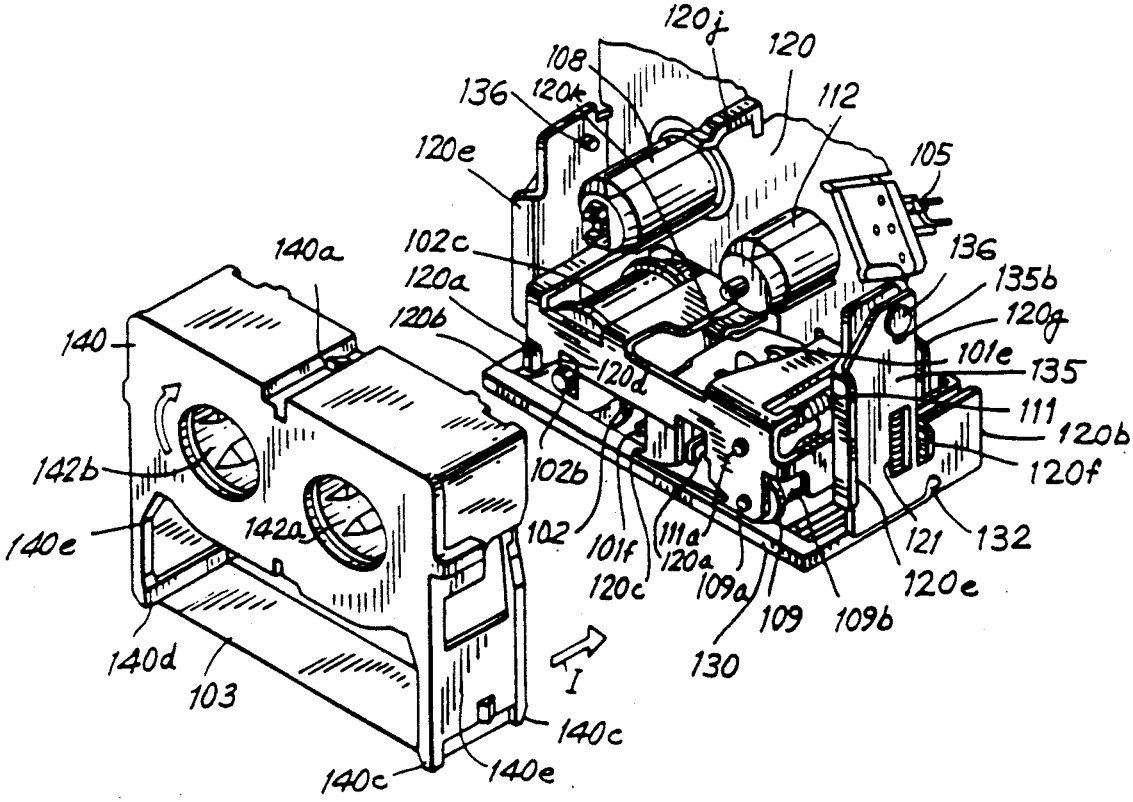
FIG. 10 is an exploded view of the printing mechanism depcited in FIG. 9 before an ink ribbon cassette is inserted in accordance with the present invention.
Figure 13:
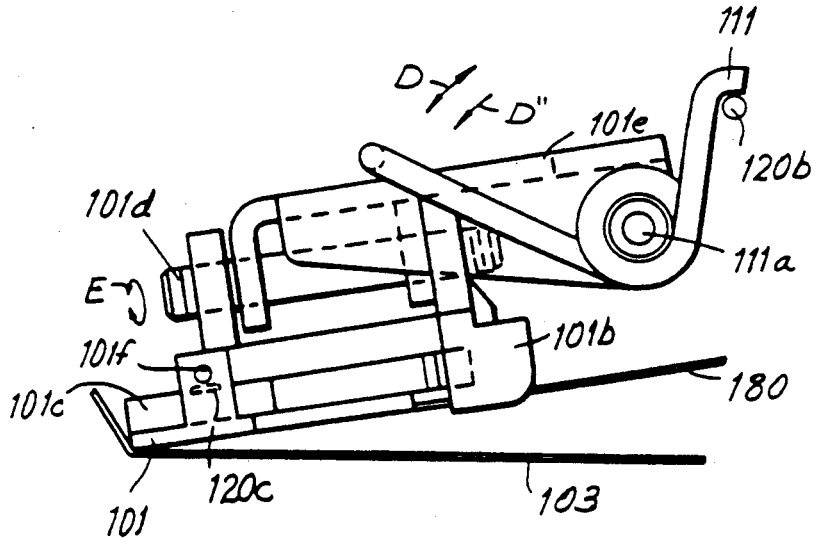
FIG. 13 is a sectional view of the thermal head when pressure is applied thereto in accordance with the invention.
Figure 14:
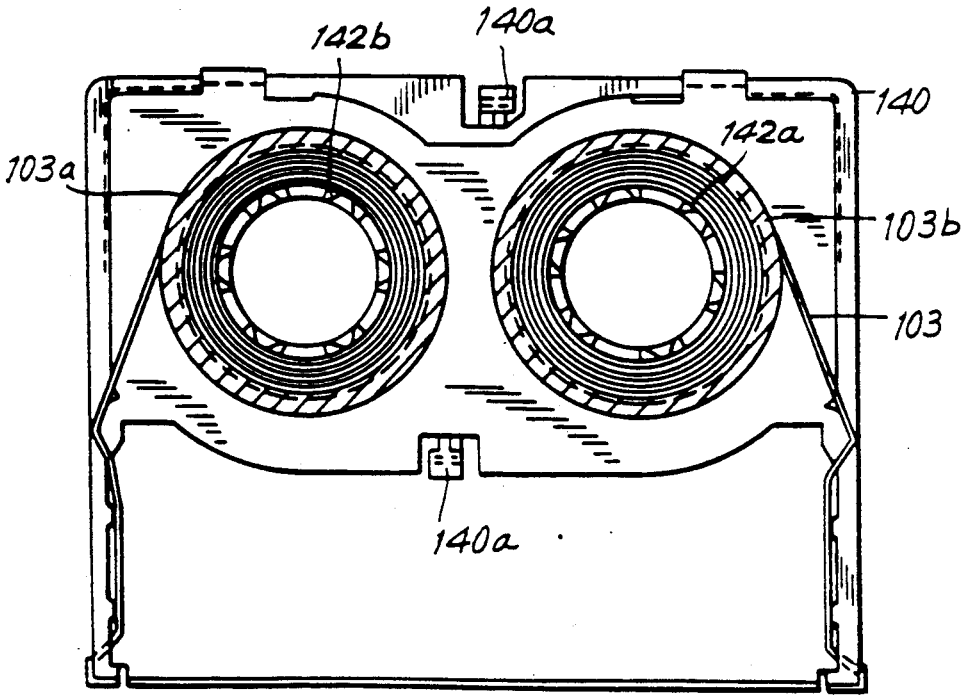
FIG. 14 is a sectional view of the ribbon cassette in accordance with the invention.

Reference is now made to FIG. 8 wherein memory unit 55 is depicted. RAM 24 is divided into an editing region 60, a storing region 61 and a printing region 62. The letter codes of the sentence which is currently being edited are stored in editing region 60. A memory cursor 63 acts as a pointer for indicating the position within editing region 60 being edited. The position 66 being indicated by cursor 63 is identical to the position being indicated by cursor 50 on display 10. By pressing save key 39 of tablet 9, the sentence which is currently being edited is stored in storing region 61. Each sentence of characters is stored in its own portion of storing region 61. A second memory pointer 64 indicates which sentence within storing region 61 is presently being acted upon. Pushing memory load key 40 causes the sentence indicated by pointer 64 within storing region 61 to be loaded into editing region 60 and simultaneously be displayed on liquid crystal display 10. Pointer 64 is incremented after each loading. During the printing of the edited sentence, print region 62 signals print character generator 27 to print the letter codes corresponding to the code in the editing region 60 directly to print region 62 thereby forming the letter font to be transmitted to thermal head 2. RAM 24 maintains the information stored therein through a backup power source 25 or battery even when switch 38 is turned off.

Printing is begun by pressing print starting key 37 located on tablet 9. CPU 20 calls the letter code of the sentences to be printed from the corresponding codes of print character generator 27 and signals print character generator 27 to transmit this information to print region 62 within RAM 24. Printer 68 is now prepared for printing and will begin printing upon manual operation through movement against a print surface 160. Printer 68 is lifted and then pressed against a print surface 160, such as print paper, and slid in the direction of arrow A (FIG. 2). This causes roller 6 to rotate causing transmitting gear 7 to rotate causing the rotation of the detection plate 3 causing photo detector 4 to generate pulse signals. CPU 20 detects these pulse signals and senses the sliding of printer 68. In response to the pulse signals, CPU 20 causes the print character generator 27 to send print codes to thermal head 2 thereby effecting printing on the print surface 160. Because the input speed of detector 4 is in response to the actual slide speed of printer 68 on print surface 160, it becomes possible to print the characters and drawings uniformly since the output of the printer 68 is synchronous with the speed of movement.

Ribbon take up reel 8 rotates simultaneously with transmitting gear 7 causing ribbon 16 to be rolled up at the same rate as the print speed.

Battery 12 is used as a power source supplying power to head driving circuit 21, tablet driving circuit 22, CPU 20 and ROM 26, print character generator 27 and display character generator 28. RAM 24 has an independent back up power source 25 such as a battery.

By providing an input 51, a display 53 and a printing mechanism 5 as well as an apparatus for controlling these mechanisms all within a single hand-held housing 1, the printing operation from inputting through printing of characters and drawings by a hand held printer is now possible in a single operation utilizing a single portable device. Tablet 9 is used as an input by way of example only. Inputting may be possible utilizing a small keyboard for inputting all of the characters as well, or other input systems may be utilized.

Reference is now made to FIGS. 9 through 14 and 17 through 23, wherein the printing mechanism 5 of printer 68 is depicted in detail. A frame 120 supports a thermal head 101 which is mounted about a shaft 111*a* extending from frame 120. A drive roller 102 is rotatably mounted within frame 120 about a shaft 102*b* so as to trail thermal head 101 if frame 120 were moved in the direction of arrow A. Drive roller 102 is formed with a concave section 102*c*. A thermal ink ribbon 103 which passes across thermal head 101 and across drive roller 102 travels through printer 68. Concave portion 102*c* acts as a guide for thermal ribbon 103. Drive roller 102 includes a one-way clutch which allows for rotation of drive roller 102 only in the direction of arrow B corresponding to movement of printer 68 in a print direction of arrow A (FIG. 11). A transmitting gear 104 is rotatably supported within frame 120. A driving gear 102*a* is integrally formed on drive roller 102 and transmits a driving force to transmitting gear 104. Drive roller 102 is formed with a first gum roller 102*d* and a second gum roller 102*e* formed at either side of drive roller 102 to come in contact with printing surface 160 thereby causing the rotation of the entire printing mechanisms without slippage. Concave section 102*c* is made of a low friction material for reducing the friction force between the back coating of thermal ribbon 103 so that thermal ribbon 103 easily passes about drive roller 102 without any excess load. As seen in FIGS. 17*a*, 17B and 17C a rotating bearing 102*g* is provided between axis 102*b* and gum roller 102*e*. When gum roller 102*e* is rotated toward arrow M, arrow C in FIG. 17A, bearing 102*g* is rotated within recess 102*f* in a free moving manner. However, gum roller 102*e* is rotated in the direction of arrow M', bearing 102*g* is quickly brought in contact with gum roller 102*e* and axis 102*b* and remains in a locked condition known as a one way clutch generally indicated as 102*i*.

A detecting plate 106 formed with a plurality of openings 106*b* about its circumference is rotatably mounted on frame 120. A detecting gear portion 106*a* of detecting plate 106 engages transmitting gear 104 thereby, rotating with drive roller 102 and transmitting gear 104. A photo interrupter 105 is triggered by openings 106*b* when detecting plate 106 is rotated. Photo interrupter 105 produces pulse signals in response to the movement of drive roller 102. A press spring 113 is located on the face of detecting plate 106 providing a friction load to detecting plate 106 preventing the production of surplus pulses by photo interrupter 105 due to over rotation of detecting plate 106 due to the inertia of rotation.

A ribbon take up core 108 is rotatably mounted in frame 120. A transmitting plate 107 rotatably mounted in frame 120 has a gear portion 107*a* which engages transmitting gear 104. Ribbon take up core 108 includes a ribbon take up shaft 108*a* and a friction plate 108*b* composed of a high friction material such as felt or the like. Ribbon take up core 108 is engaged with ribbon take up shaft 108*a* through the friction inherent from pressing against each other. A spring 108*c* mounted about ribbon take up shaft 108*a* behind transmitting plate 107 biases transmitting plate 107 against ribbon take up core 108. Transmitting plate 107 engages ribbon take up core 108 through the friction between ribbon take up shaft 108*a* and the friction plate 108*b*. Transmitting plate 107 rotates faster than ribbon take up core 108, therefore transmitting plate 107 is constructed to prevent the loosening of the thermal ribbon 103 as it is wound about take up core 108. Ribbon take up core 108 is constructed to engage with a ribbon cassette core 142*a* of a ribbon cassette 140.

A support roller 109 is rotatably mounted about a shaft 109*a* on frame 120 on the opposite side of thermal head 101 from drive roller 102. Support roller 109 is formed with a concave section 109*b* to allow passage of thermal ribbon 103 about support roller 109 and guide thermal ribbon 103 towards thermal print head 101. Concave portion 109*b* provides clearance between the print surface 160 and support roller 109 to allow thermal ink ribbon 103 to pass beneath hand held printer 68. A gum roller 109*c* is provided on the circumference of support roller 109 to contact printed surface 160 and to provide clearance between concave region 109*b* and print surface 160.

A roller press spring 110 engages a projection 120*a* extending from frame 120, thereby biasing shaft 102*b* of drive roller 102 in the direction of arrow N (FIG. 11), towards print surface 160. roller shaft 102*b* is guided by a guide groove 120*d* of frame 120 to allow slidable movement of shaft 102*b* along a predetermined distance in the direction of arrows N and N'. Thermal head 101 includes a dissipation plate 101*c* for improving the thermal responsiveness and print quality of thermal head 101 by providing a heat sink for allowing the heat to escape from thermal head 101 during operation. Dissipation plate 101*c* is held to thermal head 101 by a head holder 101*b*. Head holder 101*b* is engaged by a head pressing plate 101*e* through a head holder shaft 101*d*. Thermal head 101 and heat dissipation plate 101*c* are rotatable in the direction of arrow E (FIG. 13) about head holder shaft 101*d*. A head pressing spring 111 mounted about pivot 111*a* presses head pressing plate 101*e* toward printed surface 160 Head pressing plate 101*e* is rotatable in the direction of arrow D about the head pressing shaft 111*a*. Head pressing spring 111 is anchored at a projection 120*b* of frame 120. Thermal head 101 is controlled so that the displacement due to rotation in the direction of arrow E and the rotation in the direction of arrow D" is stopped at a predetermined position by a stopper 101*f* mounted on head holder 101*b* and stopper portion 120*c* provided on frame 120.

A ribbon cover, generally indicated as 130, acts as a guide for thermal ribbon 103 as it passes through entrance 140*c* or exit 140*d* of ribbon cassette 140. Ribbon cover 130 is supported on a slide plate 135 by a stopper pin 132. As will be discussed in greater detail below, slide plate 135 is slidably guided in the direction of arrow F (FIG. 33) to allow printer 68 to follow print surface 160. Slide plate 135 is slidably mounted on frame 120 through guide portions 120*e*, 120*f* and 120*g* of frame 120. A guide pin 136 is attached through frame 120 and slide control hole 135*b* provided on slide plate 135 to affix cover 130 to frame 120. Additionally, slide plate 135 is pressed in the direction of print surface 160 by a pair of springs 121 so that slide plate 135 is maintained at a predetermined position by guide pin 136 and slide control hole 135*b*.

Ribbon cassette 140 is detachably attached to frame 120 by two snap fit portions 140*a* of ribbon cassette 140. Ribbon cassette 140 is attachable to frame 120 by one touch in the direction of arrow I (FIG. 10) towards positioning portion 120*j* and 120*k* provided on frame 120.

A ribbon cassette core 142*b* engages with ribbon take up core 108 while a ribbon cassette core 142*a* engages a core 112 rotatably mounted on frame 120. A take up force is transmitted to ribbon cassette core 142*b* from ribbon take up core 108 to take up the used thermal ribbon 103*b*, winding the used thermal ribbon 103*b* about ribbon cassette core 142*b*. The unused portion of thermal ribbon 103*a* is wound through ribbon cassette 140 and is stretched as it passes through a cassette arm 140*e* to prevent thermal ribbon 103 from loosening. The take up force transmitted to ribbon cassette core 142*b* provides a control force like a brake providing tension for preventing thermal ribbon 103 from becoming loose at the side of the ribbon feeder.

A cable 180 of the FPC type or the like couples thermal head 101 and photo interrupter 105 to print driving controlling circuit 11.

A separating roller 131 is rotatably and detachably mounted on ribbon cover 130 between thermal head 101 and drive roller 102. Separation roller 131 is positioned between thermal ribbon 103 and print surface 160 for separating thermal ribbon 103 from print surface 160 just after printing has been performed by thermal head 101.

Reference is now made to FIGS. 24 through 27 wherein ribbon cover 130 and slide plate 135 are depicted in detail. Ribbon cover 130 is formed with two openings 130*c*, one being located at each side of ribbon cover 130. Openings 130*c* form cassette positioning guide portions which engage with thermal ribbon exit 140*c* and thermal ribbon entrance 140*d* of cassette 140. Inner walls 130*e*, 130*f* and 130*g* are formed at the edge of each opening 130*c* and form cassette positioning guide portions on ribbon cover 130 to control movement of thermal ribbon 103 across its width. The resulting inner walls act to control the position of thermal ribbon 103 on its route between inner walls 130*e* and 130*g*.

Ribbon cover 130 is coupled to slide cover 135 by a stopper pin 132 inserted into a stopper hole 130*a* of ribbon cover 130 and a rotary hole 135*a* of slide plate 135 as shown in FIG. 24. Because stopper pin 132 is rotatable when positioned in rotary hole 135*a*, ribbon cover 130 can open and close relative to slide plate 135. Therefore, when ribbon cover 130 is attached to frame 120, ribbon cover 130 is controlled by frame 120 to only open to a predetermined angle. When closing ribbon cover 130 relative to slide plate 135, closing is realized by engaging the snap fit portion 130*d* of ribbon cover 130 with positioning groove 135*d* of slide plate 135. Snap fit portion 130*d* secures ribbon cover 130 preventing ribbon cover 130 from freely opening and closing.

Figure 33:
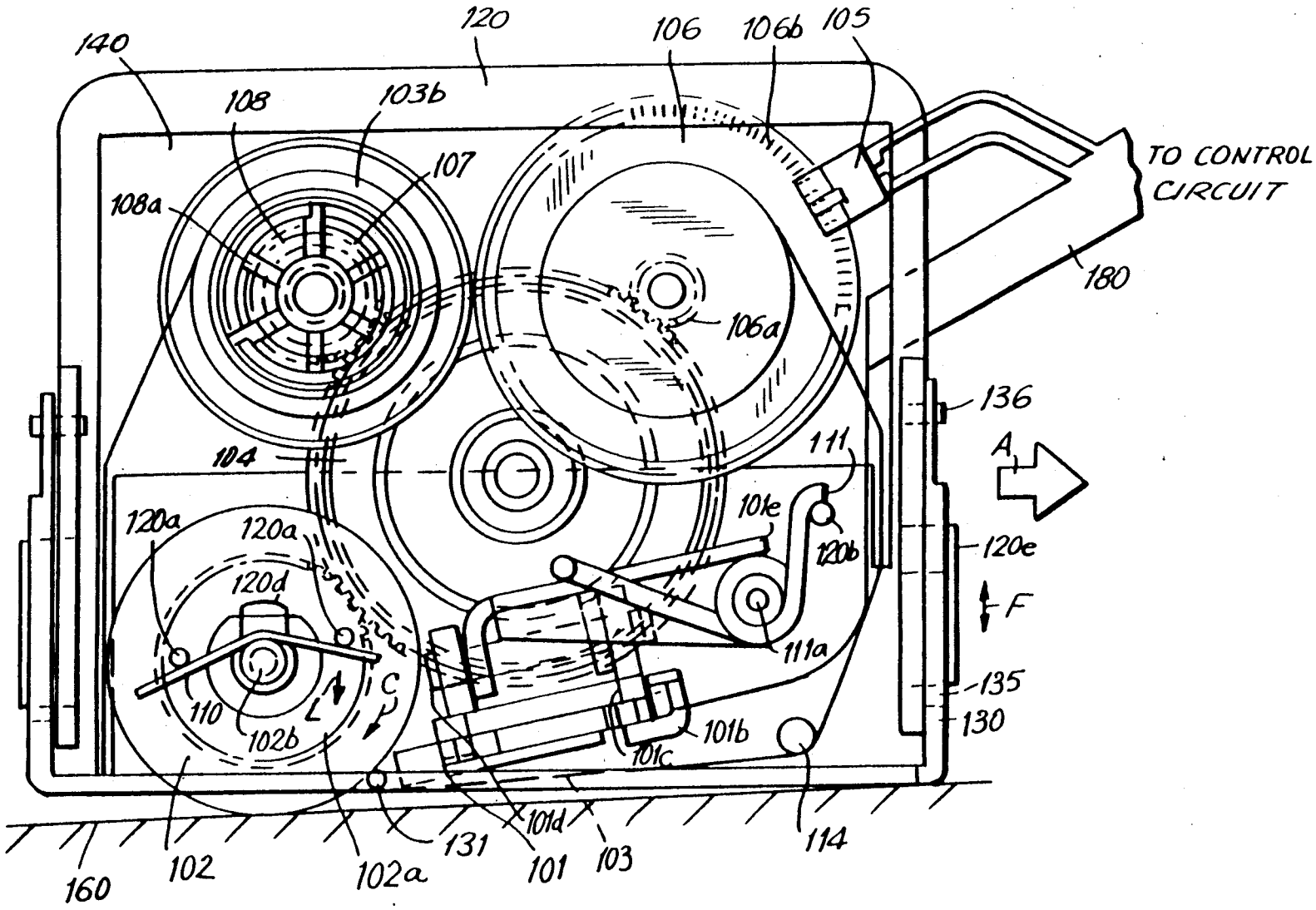
FIG. 33 is a sectional view of the printing mechanism of the hand held printer in accordance with another embodiment of the invention, shown prior to printing.
Figure 34:
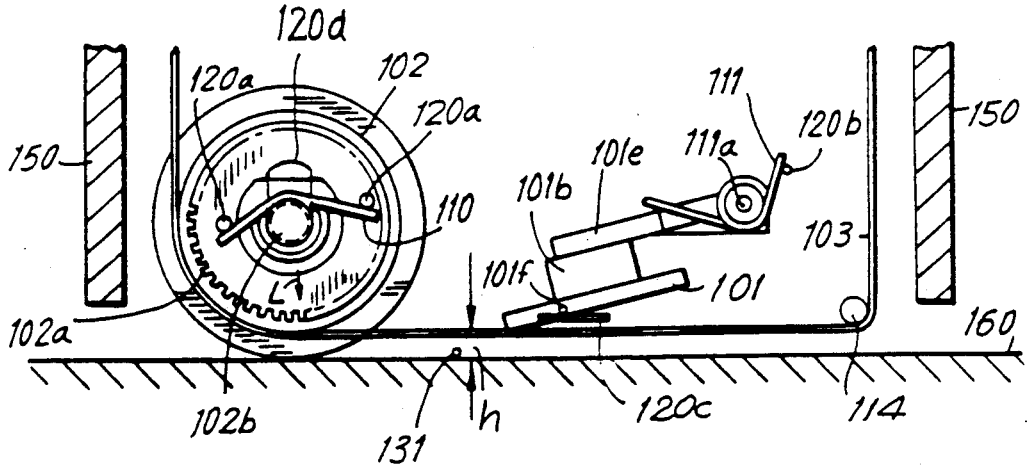
FIG. 34 is a sectional view illustrating the printer portion of the embodiment depicted in FIG. 33 prior to the application of manual pressure.
Figure 35:
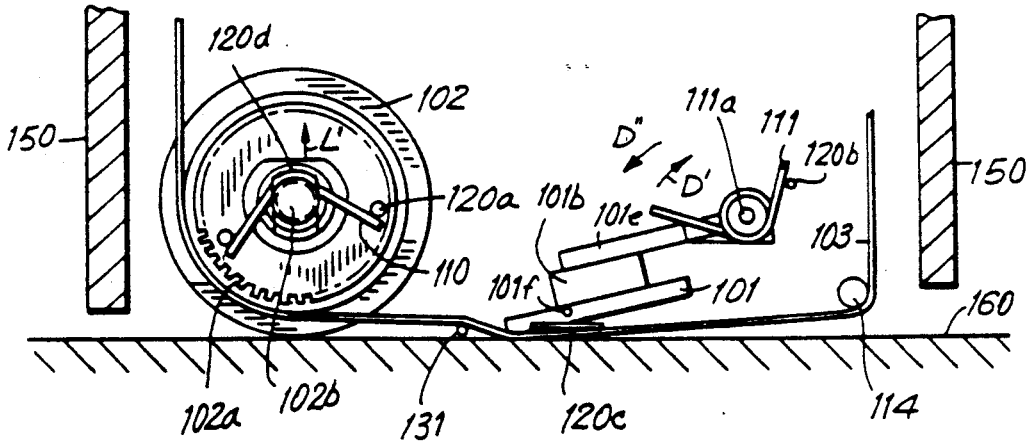
FIG. 35 is a sectional view similar to FIG. 34 illustrating the printer portion of the hand held printer during printing after pressure has been applied.
Figure 36:
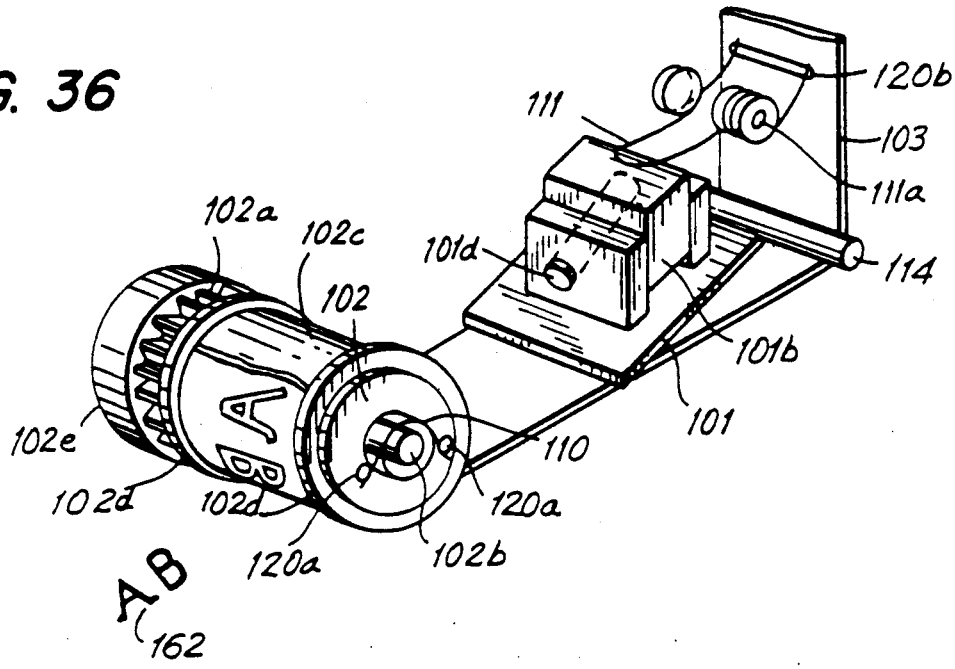
FIG. 36 is a perspective view of the printer portion of the printing mechanism depicted in the embodiment of FIG. 33.
Figure 37:
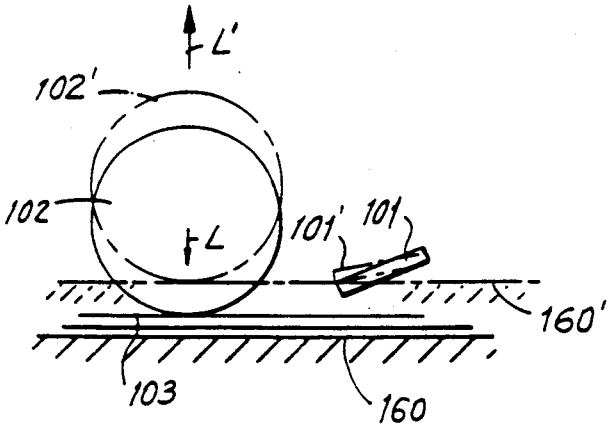
FIG. 37 is a schematic diagram illustrating the basic movement of the drive roller and print head in accordance with the embodiment of the invention depicted in FIG. 33.
Figure 38:
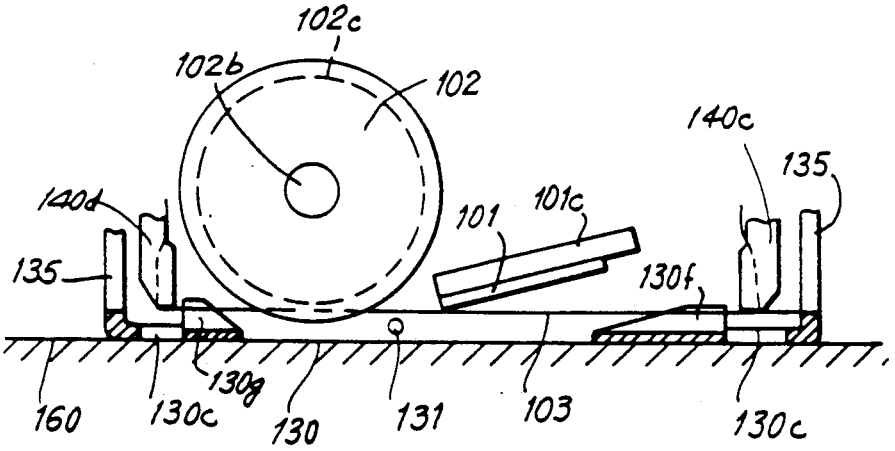
FIG. 38 is a sectional view depicting the operation of the ribbon cover prior to printing before pressure is applied in accordance with the embodiment of the invention depicted in FIG. 33.
Figure 39:
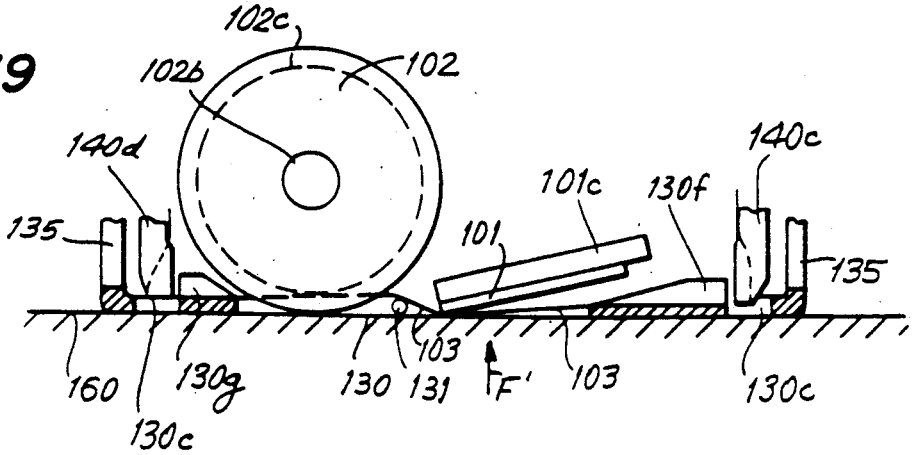
FIG. 39 is a sectional view depicting the operation of the ribbon cover in accordance with the embodiment of the invention depicted in FIG. 33 during printing after pressure is applied.
Figure 40:
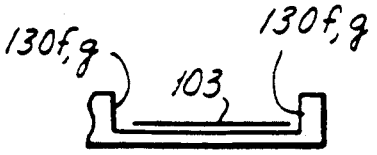
FIG. 40 is a sectional view of the ribbon guide depicted in FIG. 39 in accordance with the embodiment of the invention depicted in FIG. 33.

In the structure formed by ribbon cover 130 and slide plate 135, an arm portion 135*e* of slide plate 135 is inserted in the region of a slide guide formed from guide portions 120*e*, 120*f* and 120*g* of frame 120. Additionally, guide pin 136 is inserted through a guide pin hole 120*h* (FIG. 23) of frame 120 and through slide control hole 135*b* of slide plate 135, thereby slidably guiding the slide unit in the direction of arrow F (FIG. 33). A spring 121 is affixed in a stopper end 135*c* of arm portion 135*e* and stopper end 120*i* of frame 120 thereby pressing the slide unit in the direction of print surface 160, i.e. the direction of arrow F' ribbon cover 130 shown in phantom as 130' (FIG. 31), while the slide unit is controlled to maintain a predetermined position by slide control hole 135*b*. Accordingly, printer 68 is constructed so as to guide the projection of thermal head 101 and the traveling of thermal ribbon 103 as well as pressing ink ribbon cover 130 against print surface 160.

Figure 22:
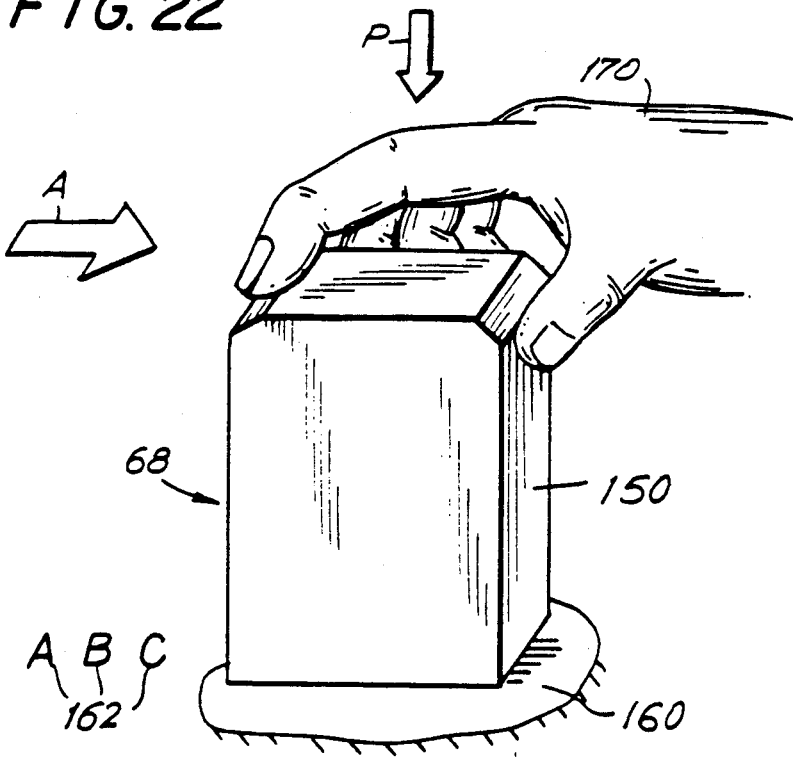
FIG. 22 is a perspective view depicting an example operation of the hand held printer in accordance with the invention.
Figure 23:
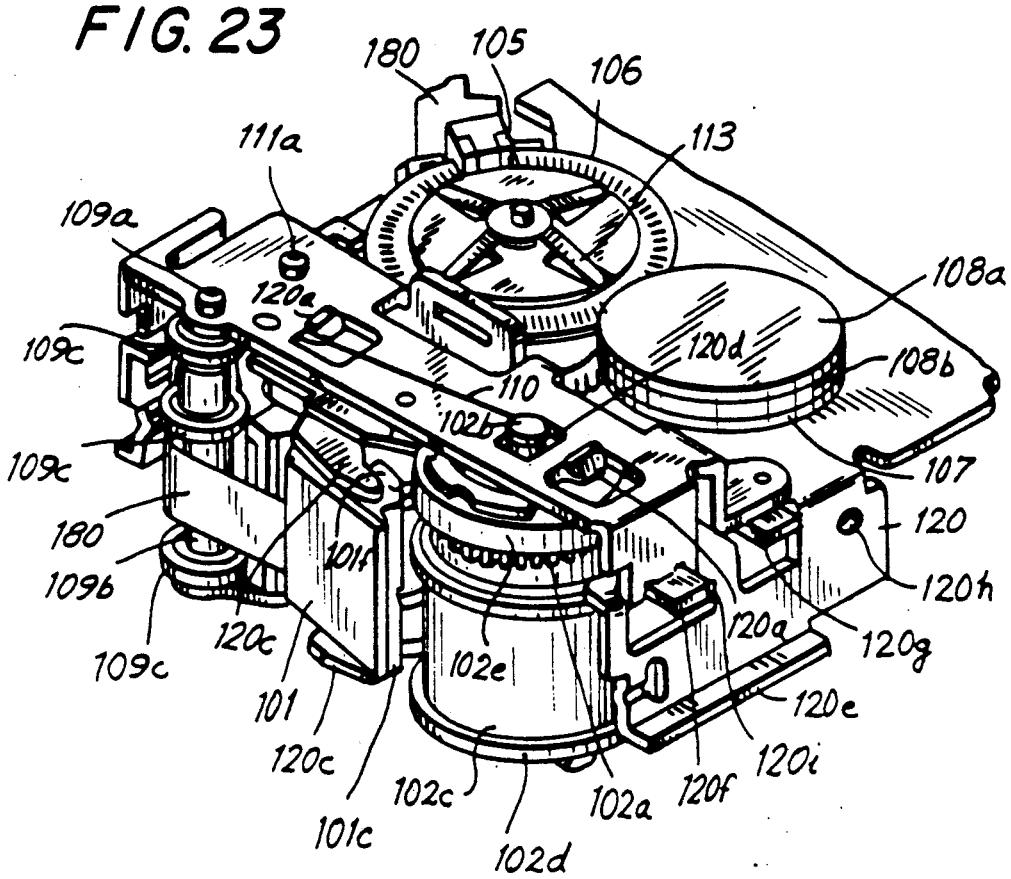
FIG. 23 is a bottom perspective view of a printing mechanism for the hand held printer in accordance with an embodiment of the invention.

Reference is now made additionally to FIG. 22 to explain operation of printer 68. A case 150, forming the housing for printer 68, is pressed towards print surface 160 in the direction of arrow P by the hand 170 of the user. Case 150 is then moved in the direction of arrow A rotating driving roller 102 due to the friction between print surface 160 and drive roller 102. Synchronous signals for printing are generated by photo interrupter 105 causing thermal head 101 to print characters 162 on print surface 160 in accordance with data stored in RAM 24.

Figure 15:
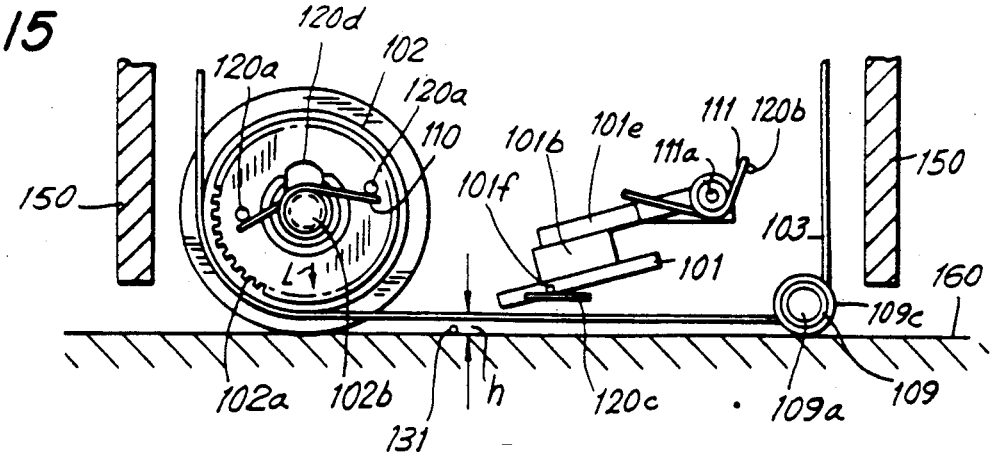
FIG. 15 is a schematic view of the printer portion of the printing mechanism of the hand held printer prior to application of pressure on the print paper.

Reference is now made to FIGS. 15 through 20. When pressure is not applied to case 150 in the direction of print surface 160 by the hand 170 of a user, the relative positioning of drive roller 102, support roller 109, thermal ribbon 103 and thermal head 101 is as shown in FIG. 15. In this position, thermal head 101 is positioned so that drive roller 102 and support roller 109 contact printed surface 160 and thermal head 101 is held at a predetermined distance h from print surface 160 by stopper 101*f* which controls the movement of thermal head 101.

Figure 16:
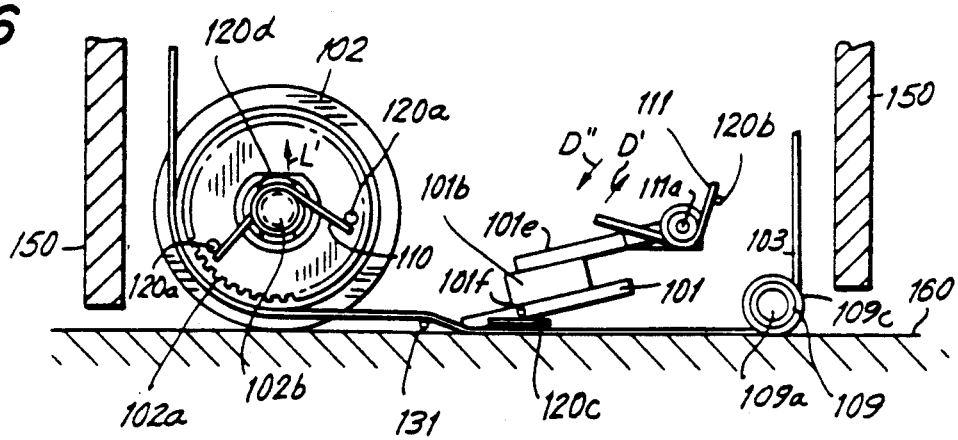
FIG. 16 is a schematic view of the printer portion of the print mechanism of the hand held printer during printing after pressure is applied in accordance with the invention.

When downward pressure is applied to case 150 by hand 170, the relative position of drive roller 120, support roller 109 and thermal head 101 is as depicted in FIG. 16. The pressure applied by hand 170 readily displaces drive roller 102 in the direction of arrow L' relative to frame 120. Drive roller 102 is smoothly displaced in the direction opposed to print surface 160. After drive roller 102 is securely pressed to print surface 160, thermal head 101 further moves in the direction of arrow D' causing head spring 111 to press thermal head 101 in the direction of arrow D'', thereby causing distance h to approach zero. Due to the pressure applied by hand 170, the condition of printer 68 is changed from that depicted in FIG. 15 to that depicted in FIG. 16. Thermal head 101 moves to a printing condition after drive roller 102 is securely pressed to print surface 160. Thermal head 101 cannot be pressed to print surface 76 entirely prior to pressing drive roller 102 to print surface 160.

Additionally, all that is required is that the pressure due to the driving force obtained from the friction force between drive roller 102 and print surface 160 is minimally larger than the driving force obtained by the drive roller 102 at the position when the drive roller 102 starts to move by pressing drive roller 102 towards print surface 160.

Accordingly, in the conventional hand held printer, since the value of h is equal to or less than zero, the drive roller cannot rotate as described above. As a result, printing starts before there has been a sufficient take up of the thermal ribbon. Therefore, the thermal ribbon begins to run out from the printer causing staining of printing and deterioration of print quality as well as operation failure. The present invention makes it possible to overcome these problems.

Figure 17:
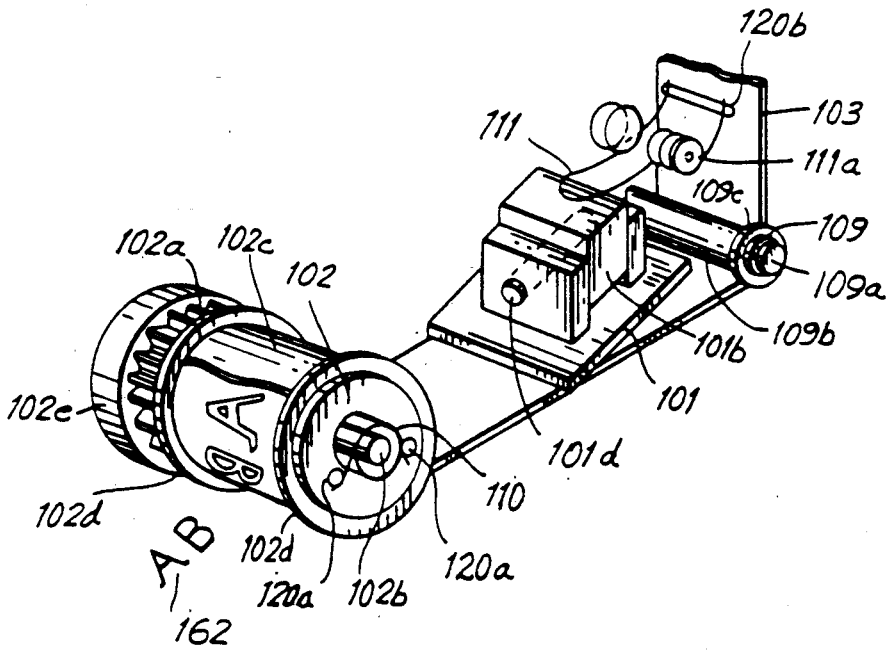
FIG. 17 is a perspective view of the print head-drive roller assembly of the hand held printer in accordance with the invention.
Figure 17A:
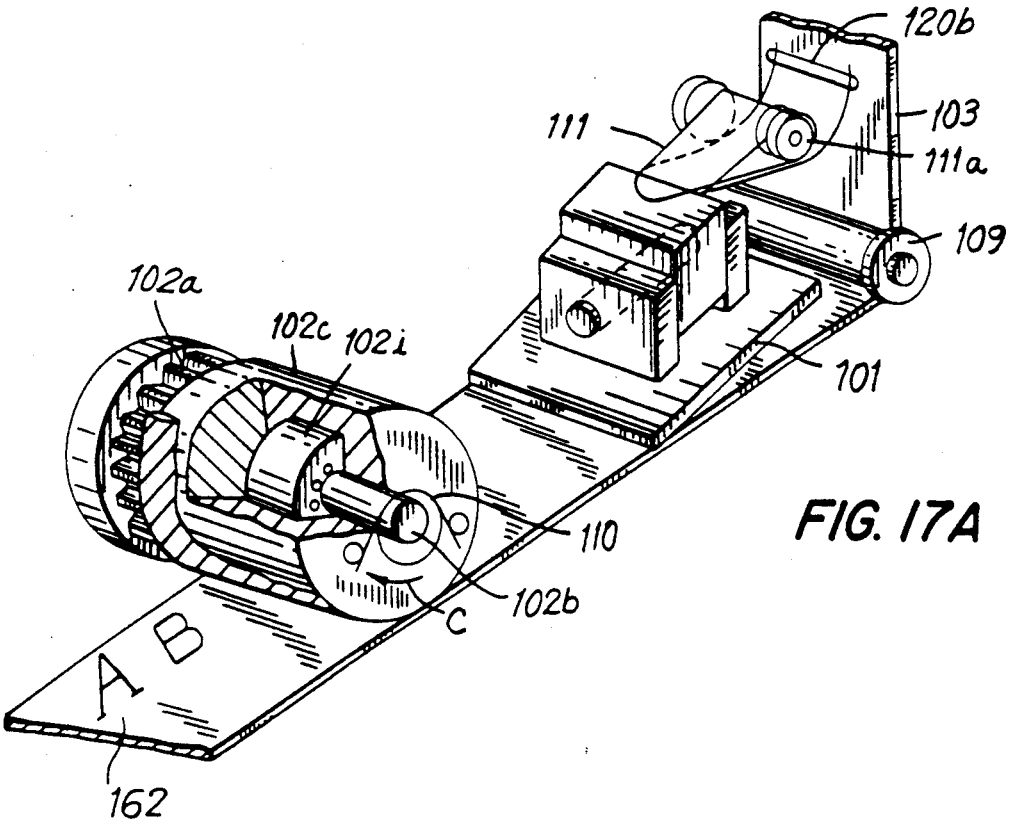
FIG. 17A is a perspective view showing a one way clutch constructed in accordance with the invention.
Figure 17B:
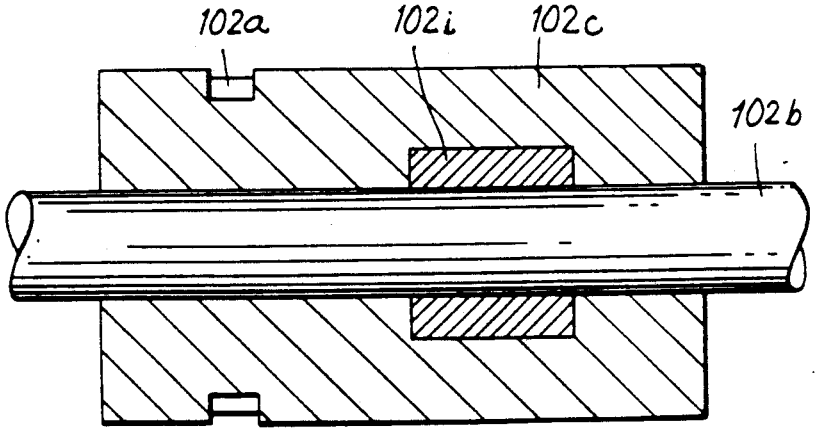
FIG. 17B is a sectional view of the one way clutch of FIG. 17A.
Figure 17C:
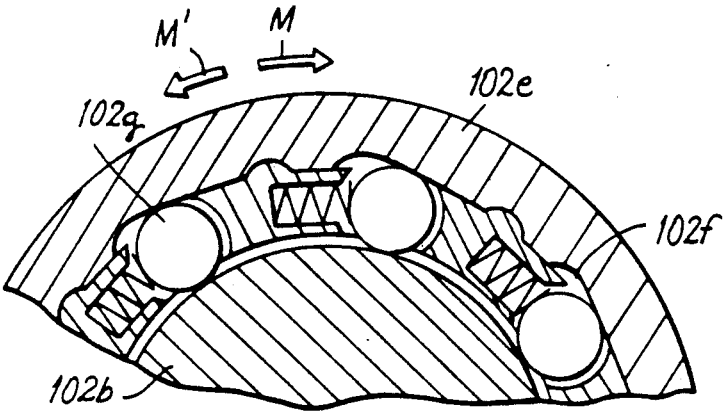
FIG. 17C is a sectional view of the one way clutch constructed in accordance with the invention.

As can be seen in FIG. 17, due to the cylindrical shape of drive roller 102, thermal ribbon 103 may pass over drive roller 102. The portion of drive roller 102 about which thermal ribbon 103 passes is concave portion 102*c*. Due to roller gum 102*d*, a guide is formed at concave portion 102*c* for guiding a portion of thermal ribbon 103 about drive roller 102. Additionally, this provides clearance between drive roller 102 and print surface 160 allowing easy passage of thermal ribbon 103 below printer 68 during printing. If the portion of drive roller 102 over which thermal ribbon 103 passes were cylindrical but did not have a concave shape, the ink of thermal ribbon 103 would adhere to print surface 160 causing staining during printing. In particular, because printer 68 is continuously printing and the surrounding portion of the print spot where ink thermal ribbon 103 comes in contact with print surface 160 due to pressure applied by thermal head 101 keeps changing, if thermal head 101 is pressed to print surface 160 by drive roller 102, this changing portion of ink is transmitted to print surface 160 forming a ghost character or causing a stain in the printing. On the other hand, when cylindrical shape of drive roller 102 does not come in contact with the passing portion of thermal ribbon 103, the cylindrical shape of the passing portion can be used.

As seen in FIGS. 18 and 19, roller shaft 102*b* slides within guide groove 120*d* of frame 120 in accordance with the movement of drive roller 102. The direction arrows L and L' correspond to the arrows in FIGS. 15 and 16.

Reference is now made to FIG. 20. Arrows L and L' correspond to arrows L and L' of FIGS. 15, and 16. The basic operation of the hand held printer 68 is dependent on whether thermal head 101 moves toward print surface 160 across a connecting line between drive roller 102 and support roller 109. The position of thermal head 101 is the reference position for operation of the hand held printer 68. When no pressure is applied to the printer 68, thermal head 101 is always located on the opposite side of the connecting line between drive roller 102 and support roller 109 at printing surface 160. However, when pressure is applied to the printer 68, drive roller 102 moves in the direction of arrow L' corresponding to the position shown as drive roller 102' due to the relative movement of print surface 160 to position 160' causing thermal head 101 to cross the connecting line between drive roller 102 and drive roller 109 to the position of thermal head 101'. Accordingly, the position of drive roller 102' must always first be pressed towards the print surface 160 making it possible for the movement of thermal head 101' to print surface 160' to be obtained by merely exerting enough pressure to move drive roller 102 to drive roller position 102'. In the present embodiment, it is movement of drive roller 102 which causes movement of thermal head 101 towards surface 160. However, as seen in FIG. 21, operation of the hand held printer 68 may still be obtained from a structure having a fixed drive roller 102. Support roller 109 contacts print surface 160 and due the pressure applied to the printer is moved to the position corresponding to support roller 109' by the relative movement of print 160 to a position represented as print surface 160'. This results in the same condition provided on drive roller 102 in FIG. 20, however, it is now made possible by the movement of 109.

Figure 31:
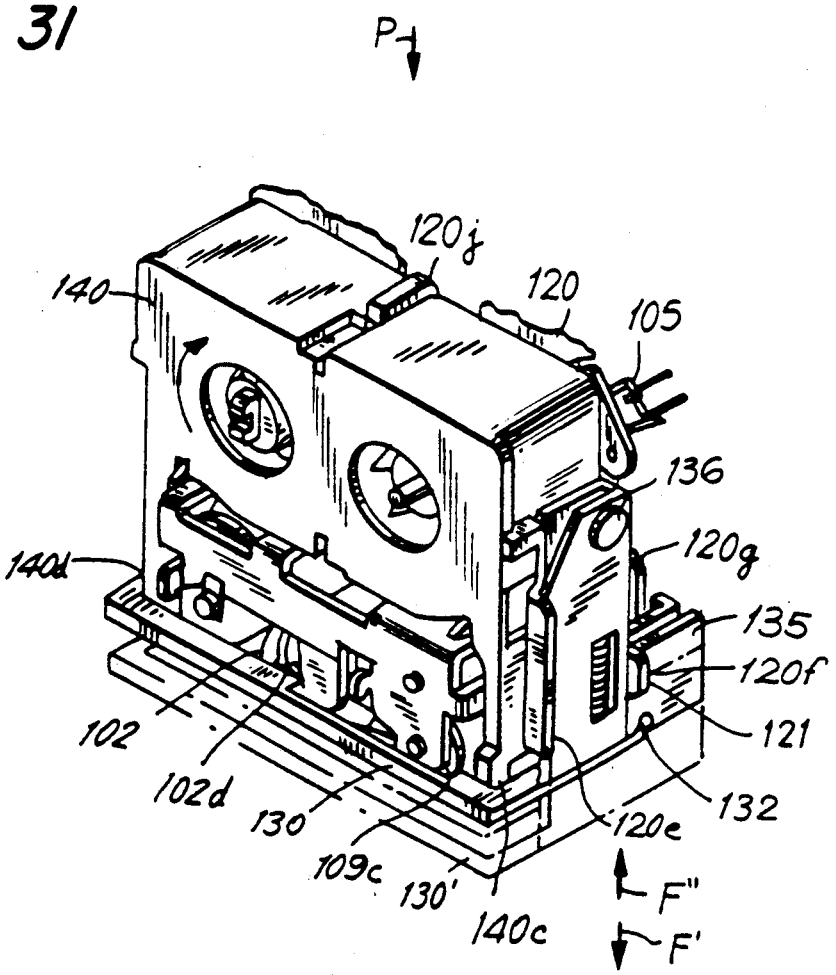
FIG. 31 is a perspective view of the printing mechanism of the hand held printer depicting the operation of the ribbon cover in accordance with an embodiment of the invention.

Reference is now made FIGS. 26 through 32 wherein operation of ribbon cover 130 a ribbon cassette 140 will be described. Spring 121 provides a F' which acts on ribbon cover 130, causing ribbon cover 130 to s at predetermined positions as shown in FIG. 31. When downward P is applied to printer 68, a force F'' acts on ribbon cover 13 shifting the connecting line between drive roller 102 and roller 109 as described above, causing the connecting line to coincide with print surface 160.

Figure 26:
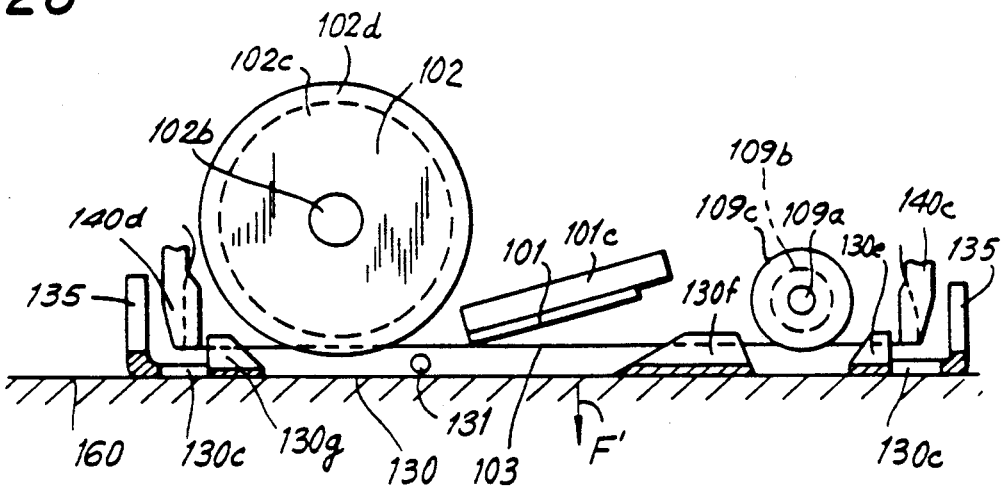
FIG. 26 is a schematic view of the operation of the ribbon cover and drive roller assembly prior to manual operation of the hand held printer before pressure is applied in accordance with the invention.
Figure 27:
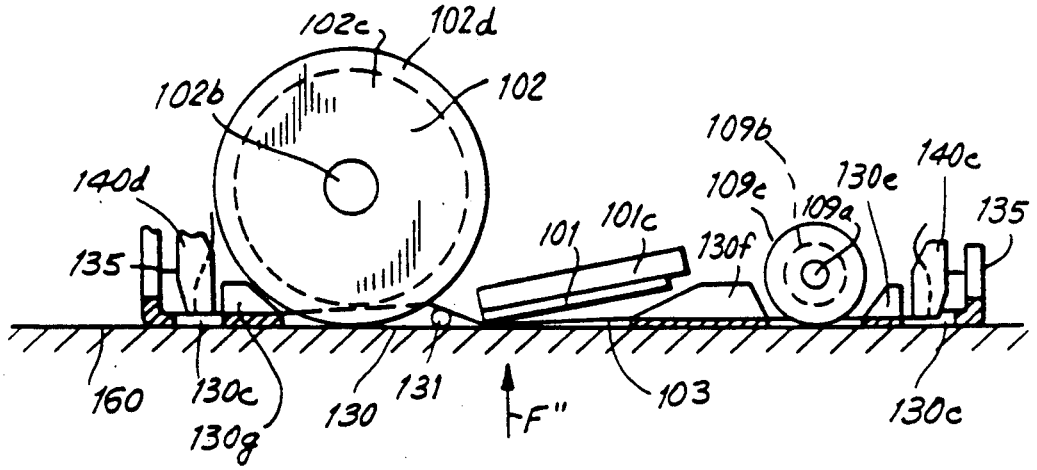
FIG. 27 is a schematic view of the ribbon cover and drive roller assembly during printing of the hand held printer in accordance with the invention.

As seen in FIG. 26, prior to the application of pressure, thermal ribbon 103 is barely engaged by the positioning control guides of ribbon cover 130 so that 103 is in an almost free floating condition within ribbon 130. When pressure is applied to hand held printer 68, as seen FIG. 27, thermal ribbon 103 becomes stretched to enable printing. Furthermore, ribbon cassette exit opening 140*c* and ribbon cassette entrance opening 140*d* engage with the positioning control guide portions of ribbon cassette 140 to prevent displacement, loosening, jamming and such between thermal ribbon 103 and thermal head 101. By pressing printer 68 against print surface 160, print surface 160 provides a pressure F'' against ribbon cover 130, thereby eliminating the gap between the print surface 160 and the support for print surface 160, thereby smoothing out any irregularities in print surface 160. For example, print surface 160 may be paper having wrinkles therein. Accordingly, thermal head 101 and thermal ribbon 103 can adhere closely to print surface 160 improving print quality.

Figure 28:
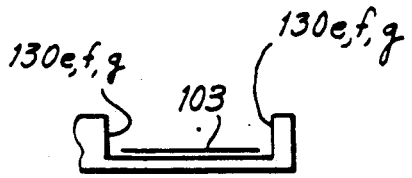
FIG. 28 is a cross sectional view of a thermal ribbon guide portion depicted in FIG. 27 in accordance with an embodiment of the invention.

As seen in FIG. 28, ribbon positioning control guide portions 130*e*, 130*f* and 130*g* are formed on ribbon cover 130. Control guide portions 130*e*, 130*f* and 130*g* are formed with a concave portion which acts to guide thermal ribbon 103 through the inner regions of the concave portion.

Figure 32:
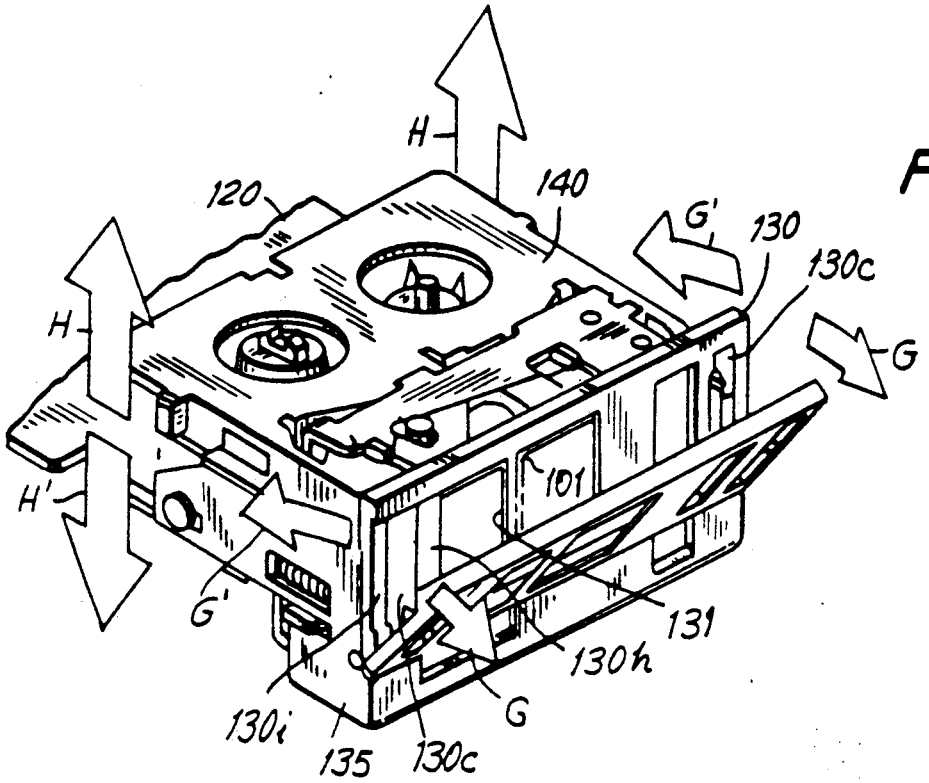
FIG. 32 is a perspective view showing the opening of the ribbon cover and the detachment of the ribbon cassette of the hand held printer in accordance with the invention.

Reference is now made specifically to FIGS. 29, 30 and 32 with which operation of ribbon cover 130 will be described. Concave portions 130*h* and 130*i* are provided on the surface of ribbon cover 130 at the contact region of ribbon cover 130 against print surface 160 in the region where print character 162 is formed. Concave portions 130*h* and 130*i* do not contact each other, preventing separation of the ink from print character 162 which is caused by direct contact with print character 162 which further increases print quality.

As described above, ribbon cover 130 is constructed for easy opening and closing so that when ribbon cassette 140 is being detached, ribbon cover 130 is opened in the direction of arrow G allowing the detachment of ribbon cassette 140 in the direction of arrow H (FIG. 32). When attaching ribbon cassette 140, ribbon cover 130 is opened in the direction of arrow G to attach ribbon cassette 140 in the direction of arrow H'. Ribbon cover 130 is then again closed in the direction of arrow G'. Accordingly, because ribbon cover 130 may easily be opened and closed, ribbon cassette 140 is easily detachable.

After printing has occurred, a predetermined cooling period for thermal ribbon 103 occurs. This period occurs when thermal ribbon 103 is separated from print surface 160. Because separating roller 102 is separated a predetermined distance behind thermal head 101 in the path of thermal ribbon 103, the separation of ink from thermal ribbon 103 is achieved after the transferring of ink to print surface 160 so that the resulting transferred ink may entirely harden. This provides for a good separation of ink from thermal ribbon 103 and prevents reverse transfer of ink to thermal ribbon 103 Additionally, since roller 131 is rotatably attached to ribbon cover 130, the unused ink which remains after printing of thermal ribbon 103 and the remains of non-melted ink, does not remain on separating roller 131. When printer 68 is held during printing, thermal ribbon 103 is automatically separated from print surface 160 due to the friction force resulting during the take up of thermal ribbon 103 and by the braking force of support roller 109 located on the side supplying thermal ribbon 103 to thermal head 101, thereby preventing any looseness in thermal ribbon 103 and any leakage of ink.

Reference is now made to FIGS. 33 through 40 which depict another embodiment of the invention. In this embodiment, support roller 109 has been replaced by a guide roller 114. Like parts are indicated with like reference numerals from the description above for the remaining parts. In this embodiment, pressure is applied to print surface 160 in a perpendicular direction by hand 170 (FIG. 22), thereby providing a print condition without support roller 109 to provide the same printing effect as the above embodiment.

In the above embodiments, prior to manual operation of printer 68, when no pressure is applied to printer 68, thermal head 101' and a drive roller 102' are positioned to be away from print surface 160 in the direction of arrow L'. Accordingly, drive roller 102 is always pressed to print surface 160 before thermal head 101 when pressure is applied in the direction of print surface 160 to perform manual operation of printer 68. Drive roller 102 can receive the rotary driving force during sliding of drive roller 102 away from print surface 160 due to the pressure applied to drive roller 102 by spring 110 to obtain the driving force required to drive drive roller 102 due to the friction force resulting from interaction with print surface 160. If further pressure is applied to printer 68, drive roller 102 separates from printed surface 160 in the reverse direction of print surface 160 once it reaches the bottom of groove 120*d*. When thermal head 101 is pressed to print surface 160 through thermal ribbon 103, the minimum pressure required for printing is obtained by head pressing spring 111. Accordingly, the conditions necessary for printing are all provided. However, this results in unstable manual operation.

To perfect operation, if pressure is further applied to printer 68 causing print roller 102*b* to contact the top of groove 120*d*, the driving force of drive roller 102 and print pressure of thermal head 101 increase to realize further stabilization during the print process. In the present embodiment, again it is always assured that drive roller 102 will be pressed against print surface 160 prior to thermal head 101, assuring the generation of a normal and secured detection signal, and normal feeding and taking up of thermal ribbon 103. Additionally, if drive roller 102 is pressed to contact the upper end of groove 120*d* located away from print surface 160, the print pressure of thermal head 101 can be secured, thereby enabling normal and secure printing.

Furthermore, in the first embodiment, when support roller 109 is added in addition to drive roller 102, the pressure applied to printer 68 is received at two points. Accordingly, manual operation becomes more stable. And, as in the embodiment of FIG. 33, by substituting shaft 114 for support roller 109, it is possible to rotate support shaft 114 about drive roller 102, so that drive roller 102 can move more smoothly. Accordingly, although operation of another embodiment has been described in context of the first embodiment in which drive roller 102 is moved, it is possible to obtain the same printing effect from a structure in which support shaft 114 is made to be moved as mentioned above.

When drive roller 102 has a cylindrical shape located on the portion of drive roller 102 where thermal ribbon 103 passes about drive roller 102, drive roller 102 and support roller 109 are formed with a concave shape so that passing thermal ribbon 103 may easily fit therein. Thereby, drive roller 102 can receive stable driving forces without any influence which may be caused by slippage of thermal ribbon 103. Support roller 109 also receives stable support as a function of the lack of slippage of thermal ribbon 103. Furthermore, it is possible to prevent staining and other imperfections of printing caused by adhesion of the ink of thermal ribbon 103 to print surface 160 due to pressure applied in a case where a drive roller 102 and support roller 109 are cylindrically shaped without the concave portion.

By providing for ribbon guides for controlling the travel of the thermal ribbon within the ribbon cassette and providing them on a slidable ribbon cover to remove any gaps between the printer and the print surface, loosening and jamming and such between the thermal ribbon and thermal head is prevented. Additionally, by opening and closing the cover which forms one portion of the ribbon guide means, the operation of detaching of the ribbon cassette is facilitated. Furthermore, by providing a separating roller which trails the thermal head during operation by a predetermined distance allows for the compulsory separating of the thermal ribbon from the print surface. By making the separating roller rotatable, unstable and left over ink is not transferred to the roller. Additionally, when the printer is stopped during operation, the separating roller prevents loosening of the ribbon and leakage of the ink due to its function of separating the thermal ribbon from the printed surface.

Furthermore, by providing a non-contact portion having a concave shape on the ribbon cover located at the portion of the ribbon cover where the characters are printed on the print surface, the separation after printing of ink which forms the printing character by being transferred from the thermal ribbon is prevented providing desirable print quality. Further, by providing a slidable ribbon cover which is acted upon by a pressure when engaging the print surface, the gap between the thermal head and print paper is removed smoothing out any irregularities in the paper with pressure providing close adhesion of the thermal head and the thermal ribbon to the print surface again improving print quality.

Figure 41:
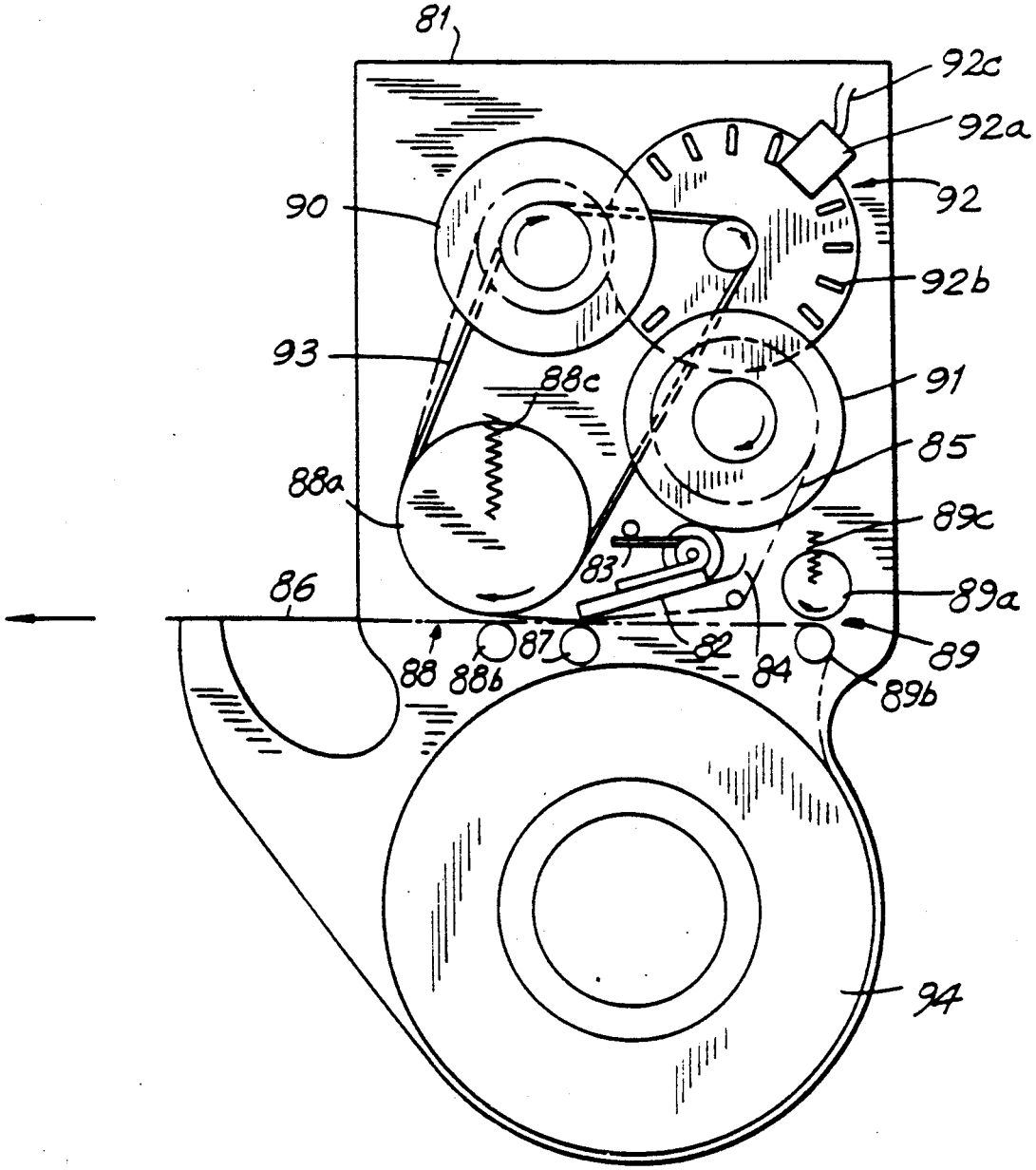
FIG. 41 is a schematic view of another embodiment of the hand held printer in accordance with the invention.

Reference is now made to FIG. 41 wherein another embodiment of the invention in which a printer using drawn out tape is provided. A body or housing 81 supports a thermal print head 82. A head pressing spring 83 is mounted on body 81 to provide a downward force on thermal head 82. A cable 84 connects thermal head 82 to a CPU 20 (FIG. 4). An adhesive tape 86 ("mending tape") is wound around tape holder 94. A thermal ribbon 85 is stored on a supply reel 91 and travels along a path past thermal head 82 to a take up reel 90. A roller type platen 87 presses ink ribbon 85 and mending tape 86 against thermal head 82. A drive roller group, generally indicated as 88, consists of an upper roller **88*a* above mending tape 86 and a lower roller 88*b* below mending tape 86. Drive roller 88, sandwiches mending tape 86 from both above and below mending tape 86 as shown in phantom and rotates as mending tape 86 passes between rollers 88*a*, 88*b* when tape 86 is pulled in a direction of arrow K. Ink ribbon 85 also passes between rollers 88*a* and 88*b* prior to be wound on take up reel 90. A spring 88*c* biases roller 88*a* against roller 88*b***.

A roller group generally indicated as 89 separates mending tape 86 from tape holder 94. Roller group 89 includes a side roller **89*a* above mending tape 86, a roller 89*b* below mending tape 86 and a spring 89*c* for biasing roller 89*a* against roller 89*b*. A detecting apparatus generally indicated as 92 detects the amount of tape 86 drawn out from body 81. Detecting apparatus 92 includes a photo detector 92*a*, a detecting plate 92*b* and a cable 92*c* for transmitting the output of photo detector apparatus 92 to CPU 20. A timing belt 93 couples roller 88*a* to detecting plate 92*b* and take up reel 90 thereby transmitting the rotation of roller 88*a* to ribbon take up reel 90 and detecting plate 92*b***.

When mending tape 86 is manually drawn out in the direction of arrow K, roller **88*a* rotates, rotating ribbon take up reel 90 and detecting plate 92*b* due timing belt 93. Ribbon 85 is rolled up through the rotation of ribbon take up reel 90. Photo detector 92*a* generates pulse signals based upon the rotation of detecting plate 92*b*. When CPU 20 senses the generated signal, the pattern of characters and drawings are then output to thermal head 82** to cause printing.

Even when the draw out speed of tape 86 is varied to some degree, the generated pulse signals from photo detector **92*a*** will also vary with the same degree thereby insuring uniform printing of characters and drawings.

A press spring 83 presses thermal head 82 towards ink ribbon 85 and mending tape 86 against platen 87. Roller **89*b* acts to separate mending tape 86 from mending tape holder 94 when a drawing force is applied to mending tape 86. Rollers 88*a* and 88*b* which rotate with the drawing out of tape 86, are pressed by spring 88*c* to prevent ribbon 85 and mending tape 86 from sliding. The printer of FIG. 41 may accommodate different thicknesses of mending tape 86 because of the spring mechansim which may vary the distances applied by roller groups 88 and 89. Roller group 88 includes a one-way clutch which prevents rotation of the roller group 88** in a reverse direction.

The present emobiment utilizes mending tape, however the printer is equally applicable to paper tapes and other tapes. Additionally, a transmission gear may be substituted for the timing belt.

By providing an extremely small hand held printer which includes the print mechanism, input and output of a single unit and which is manually operated, improved hand held printer which is applicable for wider usage than prior word processors and manual printers is obtained.

Furthermore, in accordance with the above embodiments of the invention, it is possible to obtain consistent and accurate print signals, feed ribbon and take up ribbon operations with an extremely simple mechanism. Additionally, misprinting due to deviations of the thermal ribbon, loosening, projecting, jamming and stepping out of the thermal ink ribbon from the thermal head are avoided providing an easily detachable ribbon cassette. Additionally, by reducing the pressure necessary to be applied to the body of the printer, staining of the characters and drawings just after printing is avoided. Further, by providing a slidable cover, the gap between the print surface and thermal head is removed preventing misprinting on crumpled paper surfaces. Accordingly, the present invention improves print quality operatability of the hand held thermal transfer printer thereby entirely removing faults of the prior art.

Additionally, by removing the driving motor and control circuit it is possible to even further miniaturize portable lettering printers utilizing a simple mechanism.

Additionally, in a hand held tape printing printer, by providing springs in the rollers, it becomes possible to use a variety of mending tapes.

It will thus be seen that the objects set forth above, among those made apparent from the preceding description, are efficiently obtained and since certain changes may be made in the above constructions without departing from the spirit and the scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which is a matter of language might be said to fall therebetween.

What is claimed is:

1. A printing mechanism for a hand held printer which prints characters and drawings on a print paper by manual movement of said printer over the surface of said print paper, said printer being movable in a print direction and a nonprint direction over said print paper surface by manually pressing the printing mechanism to the print paper, the printing mechanism comprising a thermal print head movably supported in the printer, a thermal transfer ribbon supported in the printer, thermal head biasing means for biasing the thermal print head through the thermal transfer ribbon to the print paper, ribbon take up means for winding the ribbon, movement measurement means for generating a signal corresponding to movement of the printer over the print paper, drive roller means for driving the ribbon take up means and movement measurement means, clutch means engaging the drive roller means and only rotatable in the print direction, drive roller biasing means for biasing the drive roller means in a predetermined direction, and displacement means acting independently of the thermal head biasing means for moving the drive roller means independently of the thermal print head to the print surface when the drive roller means is biased by the drive roller biasing means.

2. The printing mechanism for a hand held printer of claim 1, wherein the displacement means includes guide means for guiding and engaging the drive roller means when the drive roller means is movable relative to the print surface.

3. The printing mechanism for a hand held printer of claim 2, wherein the hand held printer further comprises a frame having a groove therein, and the guide means includes the groove for supporting the drive roller means and said drive roller means is slidable relative to a print surface.

4. The printing mechanism for a hand held printer of claim 1, wherein the displacement means comprises a support member for supporting the thermal ribbon, the support member being rotatable relative to the print surface.

5. The printing mechanism for a hand held printer of claim 1, wherein a portion of the thermal ribbon passes about the drive roller means, the drive roller means being formed into a shape dimensioned to receive the ribbon.

6. The printing mechanism for a hand held printer of claim 5, wherein the shape of the drive roller means is concave.

7. The printing mechanism for a hand held printer of claim 4, wherein a portion of the thermal transfer ribbon passes about the support member, the support member being formed in a shape dimensioned to receive the thermal ribbon.

8. The printing mechanism for a hand held printer of claim 4, wherein the shape of the support member is concave.

9. The printing mechanism for a hand held printer of claim 1, wherein the head biasing means is a spring which presses against the thermal head.

10. The printing mechanism for a hand held printer of claim 1, wherein the roller biasing means comprises a spring for pressing the roller.

11. The printing mechanism for a hand held printer of claim 1, wherein the drive roller means comprises a drive roller.

12. The printing mechanism for a hand held printer of claim 4, wherein the support member comprises a support roller.

13. The printing mechanism for a hand held printer of claim 4, wherein the support member is a shaft.

* * * * *